US009038389B2

(12) United States Patent
Palmer

(10) Patent No.: US 9,038,389 B2
(45) Date of Patent: May 26, 2015

(54) HYBRID THERMAL CYCLE WITH INDEPENDENT REFRIGERATION LOOP

(75) Inventor: William Robert Palmer, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 139 days.

(21) Appl. No.: 13/533,497

(22) Filed: Jun. 26, 2012

(65) Prior Publication Data

US 2013/0340434 A1 Dec. 26, 2013

(51) Int. Cl.

| | |
|---|---|
| ***F01K 13/00*** | (2006.01) |
| ***F01K 9/00*** | (2006.01) |
| ***F01K 17/00*** | (2006.01) |
| ***F01K 19/04*** | (2006.01) |
| ***F01K 25/06*** | (2006.01) |

(52) U.S. Cl.

CPC ..... *F01K 9/003* (2013.01); *F01K 17/005* (2013.01); *F01K 19/04* (2013.01); *F01K 25/06* (2013.01)

(58) Field of Classification Search

CPC ..... F03G 6/067; F01K 13/00; F01K 25/08; F01K 19/00; F01K 11/00

USPC ..... 60/641.2, 645, 651, 676

See application file for complete search history.

(56) References Cited

U.S. PATENT DOCUMENTS

| | | | | |
|---|---|---|---|---|
| 3,007,306 | A | 11/1961 | Martin et al. | |
| 3,636,706 | A | 1/1972 | Minto | |
| 3,935,710 | A | 2/1976 | Dickinson | |
| 3,955,358 | A * | 5/1976 | Martz et al. | 60/39.182 |
| 4,009,587 | A | 3/1977 | Robinson, Jr. et al. | |
| 4,106,294 | A * | 8/1978 | Czaja | 60/649 |
| 4,196,594 | A * | 4/1980 | Abom | 60/649 |
| 4,207,842 | A * | 6/1980 | Kehlhofer | 122/406.4 |
| 4,283,211 | A | 8/1981 | Ehrlich et al. | |
| 4,291,538 | A | 9/1981 | Husain et al. | |
| 4,366,675 | A | 1/1983 | Nishioka | |
| 4,448,030 | A * | 5/1984 | Moss | 62/79 |
| 4,465,027 | A * | 8/1984 | Steinegger | 122/406.4 |

(Continued)

FOREIGN PATENT DOCUMENTS

| | | | | |
|---|---|---|---|---|
| DE | 3327838 | A1 * | 12/1983 | 60/670 |
| DE | 198 04 845 | A1 | 8/1999 | |

(Continued)

OTHER PUBLICATIONS

English Translation JP 2001108201 A.*

(Continued)

*Primary Examiner* — Kenneth Bomberg
*Assistant Examiner* — Shafiq Mian
(74) *Attorney, Agent, or Firm* — Robert J Sacco, Esq.; Fox Rothschild LLP

(57) ABSTRACT

Work is produced from heat in a continuous cycle. A flow of first working fluid is provided to a high pressure boiler to produce a flow of first working fluid vapor. A second working fluid in vaporous form is compressed, after which a third working fluid is formed by mixing the first working fluid vapor and the second working fluid. Thermal energy is transferred directly between the first and second working fluids in the mixing chamber exclusive of any intervening structure. A refrigeration loop containing a fourth working fluid extracts thermal energy from a low grade thermal energy source and moves the thermal energy to the first working fluid and/or the second working fluid.

4 Claims, 11 Drawing Sheets

(56) References Cited

U.S. PATENT DOCUMENTS

| | | | | | |
|---|---|---|---|---|---|
| 4,484,446 | A | | 11/1984 | Goldsberry | |
| 4,501,233 | A | * | 2/1985 | Kusaka | 122/406.4 |
| 4,548,043 | A | | 10/1985 | Kalina | |
| 4,569,207 | A | * | 2/1986 | James | 62/235.1 |
| 4,660,511 | A | * | 4/1987 | Anderson | 122/420 |
| 4,793,132 | A | * | 12/1988 | Okabe | 60/39.182 |
| 4,876,855 | A | | 10/1989 | Yogev et al. | |
| 4,905,481 | A | * | 3/1990 | Scaringe et al. | 62/500 |
| 4,926,643 | A | | 5/1990 | Johnston | |
| 5,137,681 | A | * | 8/1992 | Dougherty | 376/211 |
| 5,268,942 | A | | 12/1993 | Newton et al. | |
| 5,269,148 | A | * | 12/1993 | Ludwig | 62/77 |
| 5,444,981 | A | | 8/1995 | Kakovitch | |
| 5,622,055 | A | * | 4/1997 | Mei et al. | 62/113 |
| 5,644,911 | A | | 7/1997 | Huber | |
| 5,678,420 | A | * | 10/1997 | Fukushima et al. | 62/238.6 |
| 5,727,393 | A | * | 3/1998 | Mahmoudzadeh | 62/81 |
| 6,032,467 | A | | 3/2000 | Oshita et al. | |
| 6,141,955 | A | * | 11/2000 | Akiyama et al. | 60/39.15 |
| 6,145,295 | A | | 11/2000 | Donovan et al. | |
| 6,233,940 | B1 | * | 5/2001 | Uji | 60/653 |
| 6,250,105 | B1 | | 6/2001 | Kimble | |
| 6,413,484 | B1 | | 7/2002 | Koch | |
| 6,523,347 | B1 | * | 2/2003 | Jirnov et al. | 60/651 |
| 6,769,256 | B1 | | 8/2004 | Kalina | |
| 6,981,377 | B2 | * | 1/2006 | Vaynberg et al. | 60/641.8 |
| 7,010,920 | B2 | | 3/2006 | Saranchuk et al. | |
| 7,096,665 | B2 | | 8/2006 | Stinger et al. | |
| 7,258,724 | B2 | * | 8/2007 | Harazim | 95/39 |
| 7,935,180 | B2 | * | 5/2011 | Weber | 95/288 |
| 8,156,726 | B1 | * | 4/2012 | Dunn | 60/39.511 |
| 8,176,724 | B2 | | 5/2012 | Smith | |
| 2002/0162330 | A1 | | 11/2002 | Shimizu et al. | |
| 2004/0123609 | A1 | * | 7/2004 | Gottlieb | 62/117 |
| 2004/0182082 | A1 | | 9/2004 | Saranchuk et al. | |
| 2005/0132713 | A1 | | 6/2005 | Neary | |
| 2006/0277910 | A1 | * | 12/2006 | Hoetger | 60/651 |
| 2009/0241546 | A1 | * | 10/2009 | Hegazy | 60/670 |
| 2009/0241860 | A1 | * | 10/2009 | Monacelli et al. | 122/7 R |
| 2010/0043433 | A1 | | 2/2010 | Kelly | |
| 2010/0051441 | A1 | * | 3/2010 | Vane et al. | 203/19 |
| 2010/0055010 | A1 | | 3/2010 | Froderberg et al. | |
| 2010/0071368 | A1 | | 3/2010 | Kaplan et al. | |
| 2010/0242476 | A1 | | 9/2010 | Ast et al. | |
| 2011/0000205 | A1 | | 1/2011 | Hauer et al. | |
| 2011/0209474 | A1 | | 9/2011 | Leibowitz | |
| 2011/0239700 | A1 | | 10/2011 | Hasse et al. | |
| 2012/0139470 | A1 | * | 6/2012 | Huff et al. | 318/739 |
| 2012/0151950 | A1 | * | 6/2012 | Jagusztyn | 62/228.1 |
| 2012/0227427 | A1 | * | 9/2012 | Liu et al. | 62/115 |
| 2012/0255304 | A1 | * | 10/2012 | Li et al. | 60/670 |

FOREIGN PATENT DOCUMENTS

| | | | | | |
|---|---|---|---|---|---|
| DE | 10227709 | A1 | | 2/2003 | |
| JP | 2000282810 | A | | 10/2000 | |
| JP | 2001-108201 | A | | 4/2001 | |
| JP | 2001108201 | A | * | 4/2001 | 60/670 |
| KR | 101045802 | B1 | * | 6/2010 | 60/645 |
| WO | 02/073007 | A2 | | 9/2002 | |
| WO | 2004/033859 | A1 | | 4/2004 | |
| WO | 2006/028444 | A1 | | 3/2006 | |
| WO | 2006/105815 | A1 | | 10/2006 | |
| WO | 2012/076902 | A1 | | 6/2012 | |
| WO | 2012151055 | A2 | | 11/2012 | |
| WO | 2013/043999 | A2 | | 3/2013 | |

OTHER PUBLICATIONS

English Translation DE 3327838 A1.*

KR101045802B1 English Translation.*

International Preliminary Report on Patenability mailed Apr. 3, 2014, in application Serial No. PCT/US2012/056524 in the name of Haffis Corporation.

International Search Report and Written Opinion mailed Nov. 16, 2012; Application No. PCT/US2012/034199 in the name of Harris Corporation.

Information about Related Patents and Patent Applications, see section 6 of the accompanying Information Disclosure Statement Letter, which concerns Related Patents and Patent Applications. Jan. 10, 2013.

International Search Report and Written Opinion issued on Oct. 9, 2013 in PCT/US2012/056524 to Harris Corporation (11 pages).

International Search Report and Written Opinion mailed Oct. 9, 2013 in International Application No. PCT/US2013/047750 (11 pages).

International Search Report and Written Opinion mailed Oct. 10, 2013 for International Patent Appln. No. PCT/US2013/0141506 to Harris Corporation (13 pages).

International Search Report and Written Opinion mailed Oct. 9, 2013 for International Patent Appln. No. PCT/US2013/051857 (11 pages).

Reference to U.S. Appl. No. 13/098,603, filed Dec. 23, 2013.

Reference to U.S. Appl. No. 14/138,903, filed Dec. 23, 2013.

Reference to U.S. Appl. No. 13/859,106, filed Apr. 9, 2013.

Reference to U.S. Appl. No. 14/139,094, filed Dec. 23, 2013.

Reference to U.S. Appl. No. 13/859,355, filed Apr. 9, 2013.

Reference to U.S. Appl. No. 13/859,409, filed Apr. 9, 2013.

Reference to U.S. Appl. No. 13/239,674, filed Sep. 22, 2011.

Reference to U.S. Appl. No. 13/477,394, filed May 22, 2012.

Reference to U.S. Appl. No. 13/556,387, filed Jul. 24, 2012.

* cited by examiner

HYBRID THERMAL CYCLE WITH INDEPENDENT REFRIGERATION LOOP

BACKGROUND OF THE INVENTION

1. Statement of the Technical Field

The invention concerns thermal energy cycles, and more particularly systems and methods for merging thermal energy cycles including multi-pass energy recirculation techniques which enable normally rejected thermal energy to be re-used in the cycle, repeatedly.

2. Description of the Related Art

Heat engines use energy provided in the form of heat to perform mechanical work, and exhaust a portion of the applied heat which cannot be used to perform work. This conversion of heat energy to mechanical work is performed by taking advantage of a temperature differential that exists between a hot "source" and a cold "sink." Heat engines can be modeled on various different well known thermodynamic processes or cycles. Examples of typical thermal cycles are the Brayton Cycle, the Rankine Cycle and Refrigeration Cycles.

A combined cycle is an assembly of two or more of these processes that convert heat into mechanical energy, by combining the thermodynamic cycles. The exhaust of one heat engine associated with a first cycle is used to provide the heat source that is used in a second cycle. For example, an open Brayton cycle is commonly combined with a Rankine cycle to form a combined cycle for power plant applications. The open Brayton cycle is typically implemented as a turbine burning a fuel, and the exhaust from this combustion process is used as the heat source in the Rankine cycle. In such a scenario, the Rankine cycle is referred to as a bottoming cycle because it uses some waste heat from the Brayton cycle to perform useful work. When using high temperature sources of heat (e.g. 2000° F.), a combined open Brayton cycle with a Rankine bottoming cycle can ideally be expected to provide an energy conversion efficiency as high as 60%. In the case of low temperature heat sources (e.g. 700° F.) conversion efficiencies are much lower, traditionally below about 35%.

SUMMARY OF THE INVENTION

Embodiments of the invention concern a method for producing work from heat in a continuous cycle. The invention involves communicating a first flow of a first working fluid to a low pressure boiler. A pressure of the low pressure boiler is set below a vaporization pressure of the first working fluid at the temperature of a low temperature thermal source. The first flow of the first working fluid is heated in the low pressure boiler using the low temperature thermal source to form a first flow of first working fluid vapor. A second flow of the first working fluid is provided to a high pressure boiler to produce a second flow of first working fluid vapor at a pressure higher than the low pressure boiler. The high pressure boiler uses a high temperature thermal source to heat the second flow of first working fluid. The high temperature thermal source has a temperature higher than the low temperature thermal source. The method continues by compressing a second working fluid in vaporous form, and then forming a third working fluid by mixing the first flow of first working fluid vapor, the second flow of second working fluid vapor, and the second working fluid which has been compressed. Thereafter, thermal energy is transferred directly between one or more of the second working fluid, the first flow of first working fluid vapor and the second flow of first working fluid vapor, exclusive of any intervening structure. A refrigeration loop containing a fourth working fluid is used to extract available thermal energy from within a portion of the cycle and/or from a thermal energy source external to the cycle. The refrigeration loop makes the thermal energy available to at least one of the first working fluid and the second working fluid.

The invention also includes a system for producing work from heat in a continuous cycle. The system includes a low pressure boiler having an internal pressure below a vaporization pressure of a first working fluid at the temperature of a low temperature thermal source. The boiler is configured to heat a first flow of the first working fluid using the low temperature thermal source to form a first flow of first working fluid vapor. The system also includes a high pressure boiler configured to heat a second flow of the first working fluid using a high temperature thermal source. The high temperature thermal source has a temperature higher than the low temperature thermal source. The high temperature boiler produces a second flow of the first working fluid vapor at a pressure higher than the low pressure boiler. A compressor is provided to compress a second working fluid in vaporous form. A mixing chamber is provided to form a third working fluid by mixing the first flow of first working fluid vapor, the second flow of second working fluid vapor, and the second working fluid which has been compressed. The mixing chamber is also configured to facilitate a transfer of thermal energy directly between one or more of the second working fluid, the first flow of first working fluid vapor, and the second flow of first working fluid vapor, exclusive of any intervening structure. A refrigeration loop containing a fourth working fluid is used to extract available thermal energy from within a portion of the cycle and/or from a thermal energy source external to the cycle. The refrigeration loop makes the thermal energy available to at least one of the first working fluid and the second working fluid.

BRIEF DESCRIPTION OF THE DRAWINGS

Embodiments will be described with reference to the following drawing figures, in which like numerals represent like items throughout the figures, and in which.

DETAILED DESCRIPTION

Figure 1:
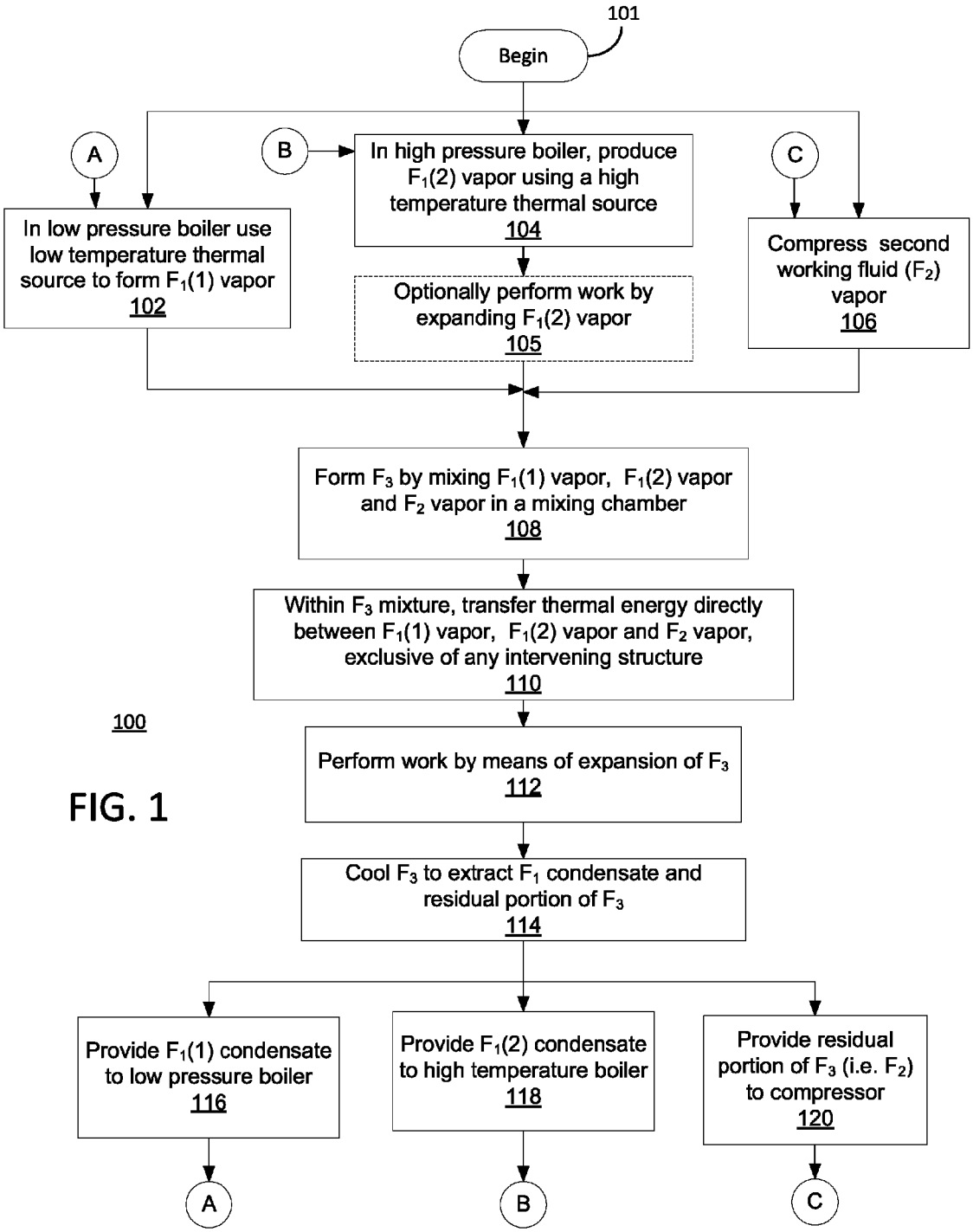
FIG. 1 is a flow chart that is useful for understanding a hybrid thermal cycle, with imbedded low pressure boiler.

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

The invention concerns a Hybrid Thermal Cycle (HTC) comprising fluids $F_1$, $F_2$, and $F_3$ where $F_3$ is comprised of a mixture of fluids $F_1$ and $F_2$. The $F_1$ fluid is a fluid construct that is advantageously selected so that it is capable of transitioning from a liquid to a vapor in some parts of the cycle, and from a vapor to a liquid during other portions of the cycle. A low pressure boiler is advantageously used in part of the cycle to enable the $F_1$ fluid to scavenge heat which is not otherwise useful in traditional engine approaches. The low pressure boiler further has the potential to absorb residual energy from locations within the overall cycle construct. Consequently, heat energy that is normally not useful or simply rejected from traditional cycle formats, is made useful within this closed cycle approach, affording the opportunity to use a higher quantity of the available thermal energy to produce power. Still, the use of the low pressure boiler is optional and the cycle can be effectively used in the absence of such low pressure boiler.

Fluid $F_2$ is preferably selected so that it remains vaporous throughout the cycle, and is preferably comprised of a high heat rate (high heating capacity) mixture such as nitrogen and helium. Other combinations could include hydrogen or argon, and in the other cases vapors similar to nitrogen alone are viable. Within a portion of the cycle the $F_2$ fluid first provides heating during a compression portion of the cycle and second provides cooling later during an expansion portion of the cycle.

The $F_1$ fluid is mixed with the $F_2$ fluid in parts of the cycle to form the $F_3$ fluid. Later in the cycle the $F_1$ fluid is separated from the $F_3$ fluid. Following a compression portion of the cycle during which $F_2$ is compressed, there is an expansion part of the cycle during which $F_3$, comprised of a mixture of $F_1$ and $F_2$, is expanded. During this expansion, the $F_1$ fluid functions to support or maintain the temperature of the $F_2$ fluid, preventing it from cooling more rapidly than without the latent heat that available from the $F_1$ fluid. If the $F_2$ fluid were expanded without the portion of the $F_1$ fluid it would cool more rapidly, having less capacity to perform work. This characteristic or effect in the cycle is desirable as it enables the fluid mixture $F_3$ to perform work for a longer period of time during expansion. This ability of $F_1$ to effectively delay the cooling of $F_2$ essentially ends when the $F_1$ fluid reaches a point where it transitions from a vapor back into a liquid. At the end of the expansion process, at least a portion of the $F_1$ fluid condenses out of the $F_3$, leaving a residual portion, which is $F_2$.

One aspect of the invention concerns the basic idea that it is possible to get more power out of a thermal source if energy is extracted at two (or more) thermal energy extraction points. The thermal extraction points are defined by thermal and pressure points that are on the working fluid saturation line. These are unique temperatures and pressures where the working fluid can have a phase transition from a liquid to a vapor. By arranging for the system to extract energy across a working fluid phase transition, it is possible to enable a larger quantity of thermal energy extraction from the thermal source. Most thermal extraction or exchange systems use a single boiler at a set output temperature (this temperature is controlled by the thermal input to the boiler.) However, it is possible to split the thermal extraction points—and by doing so it is possible to acquire a larger quantity of useful energy from the heat (thermal) source. It is therefore possible to generate a larger quantity of power from that source of heat, (with the heat of vaporization being extracted from the source at separate & unique temperature & pressure points along the working fluid saturation line.

Because of the use of latent heats to extract power from a thermal source, the quantity of power derived from the source can be considerably larger relative to the power extraction capability using only one vapor transition point (i.e., the working fluid boiling point). This process enables extracting much larger quantities of useful thermal energy and therefore enabling the production of larger quantities of useful work from a thermal source, as when compared to using only one boil off point. Notably, traditional calculations for overall cycle thermal efficiency may show little or no improvement, but when measuring the efficiency of extracting power from the same source as is the benchmark standard today—there is a considerable improvement in the extraction efficiency. The inventive cycle construct enables the thermal energy extracted at the two or more unique extraction points to be valuable in the production of power.

Referring now to FIG. 1, there is provided a flowchart that is useful for understanding a basic first embodiment of the invention. The process 100 begins in step 101 and continues with steps 102, 104, and 106. For purposes of describing process 100, it shall be assumed that separate high and low pressure boilers are used. Accordingly, in step 102, a first flow $F_1(1)$ of a first working fluid $F_1$ (in liquid form) is communicated to a low pressure boiler. A internal pressure of the low pressure boiler is chosen so that it is approximately equal to a vaporization pressure of the first working fluid at the temperature of a low temperature thermal source. The relatively low pressure within the low pressure boiler facilitates vaporization of $F_1(1)$ to form a first flow of first working fluid vapor ($F_1(1)$ vapor). More particularly, the lower pressure within the low pressure boiler facilitates vapor formation at a relatively low temperature which corresponds to the temperature of the thermal source at a lower temperature. In this way, the $F_1(1)$ fluid can effectively scavenge heat available from the low temperature thermal source which is not generally useful in other parts of the cycle. The thermal energy absorbed by the $F_1(1)$ vapor is used in various ways within the cycle as will be described below.

In step 104, a second flow $F_1(2)$ of the first working fluid $F_1$ is provided in liquid form to a high pressure boiler. In some embodiments, this step can be preceded by a pre-heating step that is not shown in FIG. 1. In step 104, the high pressure boiler produces a second flow of first working fluid vapor ($F_1(2)$ vapor) using a high temperature thermal source having a temperature higher than the low temperature thermal source. In step 105, this second flow of the first working fluid vapor can be expanded to perform useful work. The expansion of the vapor $F_1(2)$ vapor is facilitated by providing a pressure drop across an expansion device, capable of extracting useful work (power). This expansion step is optional and in some embodiments it may be omitted. However, the expanding performed in step 105 offers certain advantages. For example, this expanding step can facilitate extraction of a portion of the useful energy in the $F_1(2)$ vapor as it exits the high pressure boiler, which energy exceeds that which is available in the $F_1(1)$ vapor as it exits the low pressure boiler. The expanding step has a further advantage insofar as it can transition the $F_1(2)$ vapor to the lower pressure of the $F_1(1)$ vapor prior to the two vapors being mixed in a subsequent step. When conditions suggest that these advantages can be realized by the inclusion of the expanding step, then expanding step 105 is preferably included. Concurrently with steps 102, 104 (and optionally step 105), a second working fluid $F_2$ having a vaporous form is compressed in step 106.

The process continues in step 108 with the formation of a third working fluid $F_3$. The $F_3$ working fluid is formed as a mixture of working fluids $F_1(1)$, $F_1(2)$ and the compressed $F_2$. Within the $F_3$ mixture, thermal energy is transferred in step 110 directly between $F_1(1)$, $F_1(2)$ and the second working fluid $F_2$, exclusive of any intervening structure. In other words, the fluids are able to directly exchange or share the thermal energy they contain. Subsequently, the third working fluid is expanded in step 112 to perform useful work concurrently with or after the transference of heat described in step 110. The expansion of the vapor mixture is facilitated by providing a pressure drop across an expansion device, capable of extracting useful work (power).

The process in FIG. 1 continues by cooling the third working fluid in step 114 to extract at least a portion of the first working fluid, in the form of a condensate, from the third working fluid $F_3$. The condensing process can be comprised of traditional methods in which the excess heat within $F_3$ is displaced to the ambient surroundings. This heat displacement can be performed using cooling coils and fans and/or cooling water that is obtained either directly from ground resources or cooled using commercially available and well recognized processes.

Figure 3:
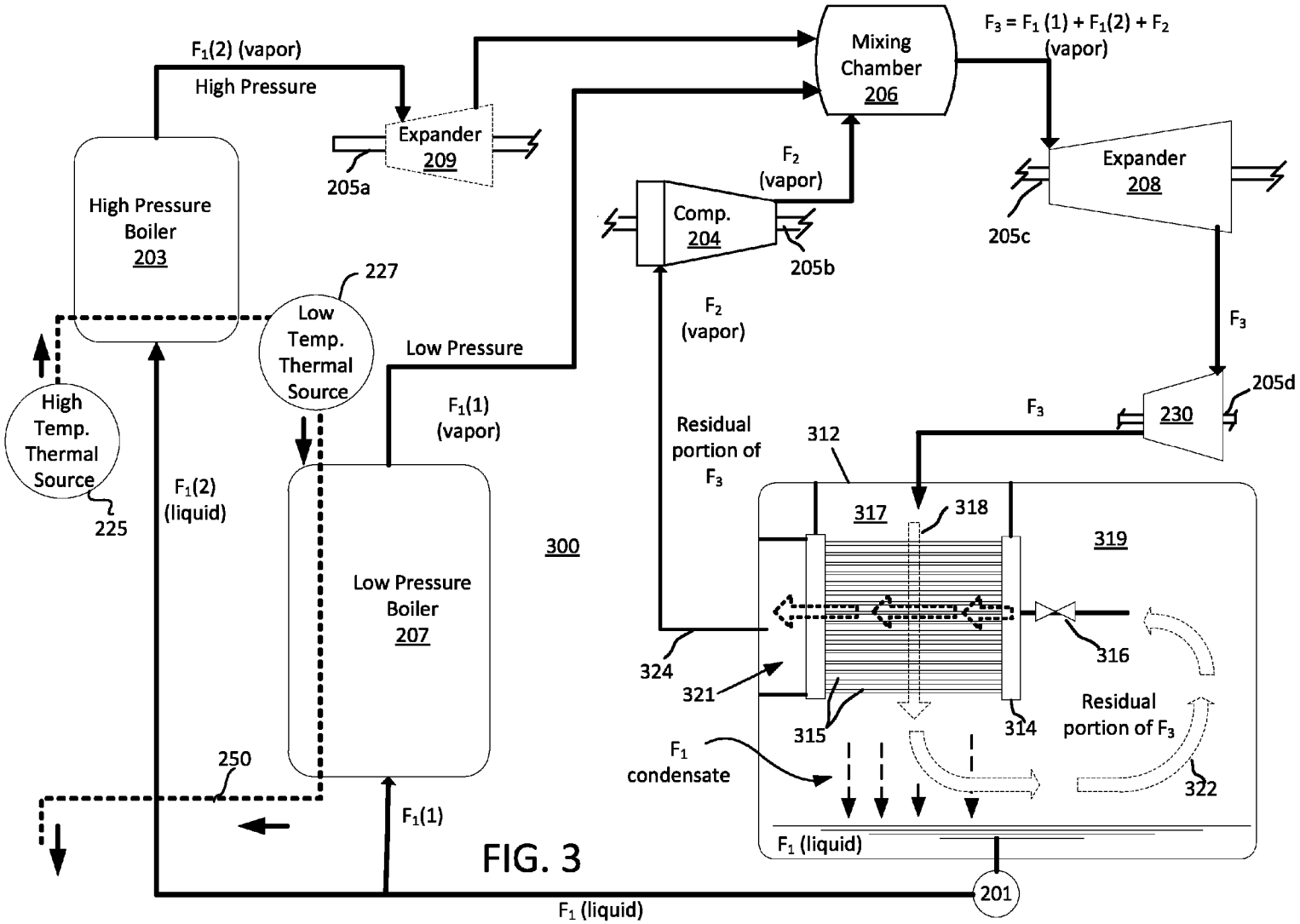
FIG. 3 is a drawing that is useful for understanding an alternative embodiment of an apparatus for implementing the hybrid thermal cycle in FIG. 1.

As an alternative to these conventional condensing methods, the liquid $F_1$ can be used directly as part of the condensing process, or an internally powered condensate method can be used. An example of such an internally powered condensate method is shown in FIG. 3 and will be described in greater detail below in relation to a system for implementing the methods described herein.

As a result of the condensing process in step 114, the $F_1$ working fluid ($F_1$ condensate) will be separated from the $F_3$ working fluid, thereby leaving a residual portion of $F_3$ from which the condensate has been extracted. This residual portion of $F_3$ is $F_2$. Thereafter, the continuous cycle is repeated using the first working fluid ($F_1$ condensate) recovered in the condensing step and the second working fluid $F_2$. More particularly, a first flow of the first working fluid $F_1$ recovered as condensate in step 114 is once again provided to the low pressure boiler as $F_1(1)$. A second flow of the first working fluid $F_1$ recovered as condensate is provided in step 118 to the high pressure boiler as $F_1(2)$. Finally, in step 120, $F_2$ working fluid (which is comprised of the residual portion of $F_3$ produced in step 114) is provided to be compressed again in step 106.

Figure 2:
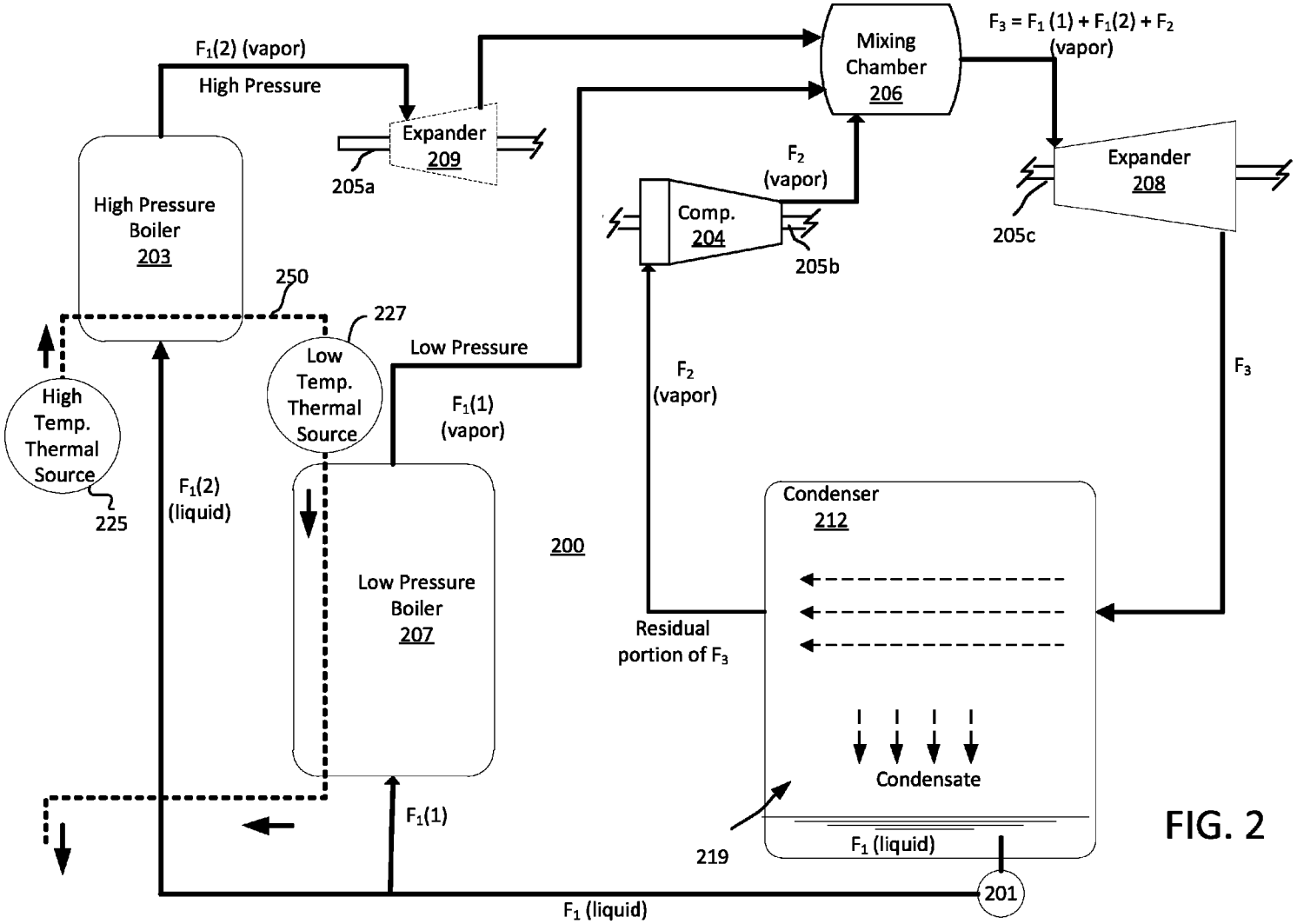
FIG. 2 is a drawing that is useful for understanding an apparatus configured for implementing the hybrid thermal cycle in FIG. 1.

The method 100 will now be described in further detail in relation to components that form an effective heat engine 200 which is shown in FIG. 2. The configuration of FIG. 2 is capable of implementing the method 100. However, it should be appreciated that the heat engine shown is merely provided by way of example and is not intended to limit the invention. Many variations of heat engines incorporating the inventive methods are possible. Accordingly, heat engines incorporating the inventive methods can include more or fewer components or steps and still remain within the scope of the invention.

The heat engine 200 makes use of a high temperature thermal source 225 and a low temperature thermal source 227. The "high temperature" nomenclature which is used to describe thermal source 225 is intended to emphasize that such thermal source is at a higher temperature as compared to the temperature of low temperature thermal source 227. Although thermal source 225 will have a higher temperature compared to low temperature thermal source 227, it should be appreciated that high temperature thermal source 225 can actually have a relatively low temperature as compared to those temperatures which are normally used to provide efficient operation of a conventional heat engine. For example, in some embodiments, the high temperature thermal source 225 may actually only have a temperature of about 800° F. or less. In other embodiments, the high temperature thermal source 225 can have a temperature of about 400° F. or less. The ability to efficiently utilize such sources of heat is a significant advantage of the present invention.

Suitable choices for working fluids $F_1$ and $F_2$ will be described below in further detail. Still, given the anticipated temperatures for thermal source 225, 227, it can be advantageous to select the working fluid $F_1$ to be a low vapor state formulation to facilitate vaporization of such working fluid at relatively low temperatures. Examples of such low vapor state formulations can include fluids such as methanol or pentane.

Figure 4:
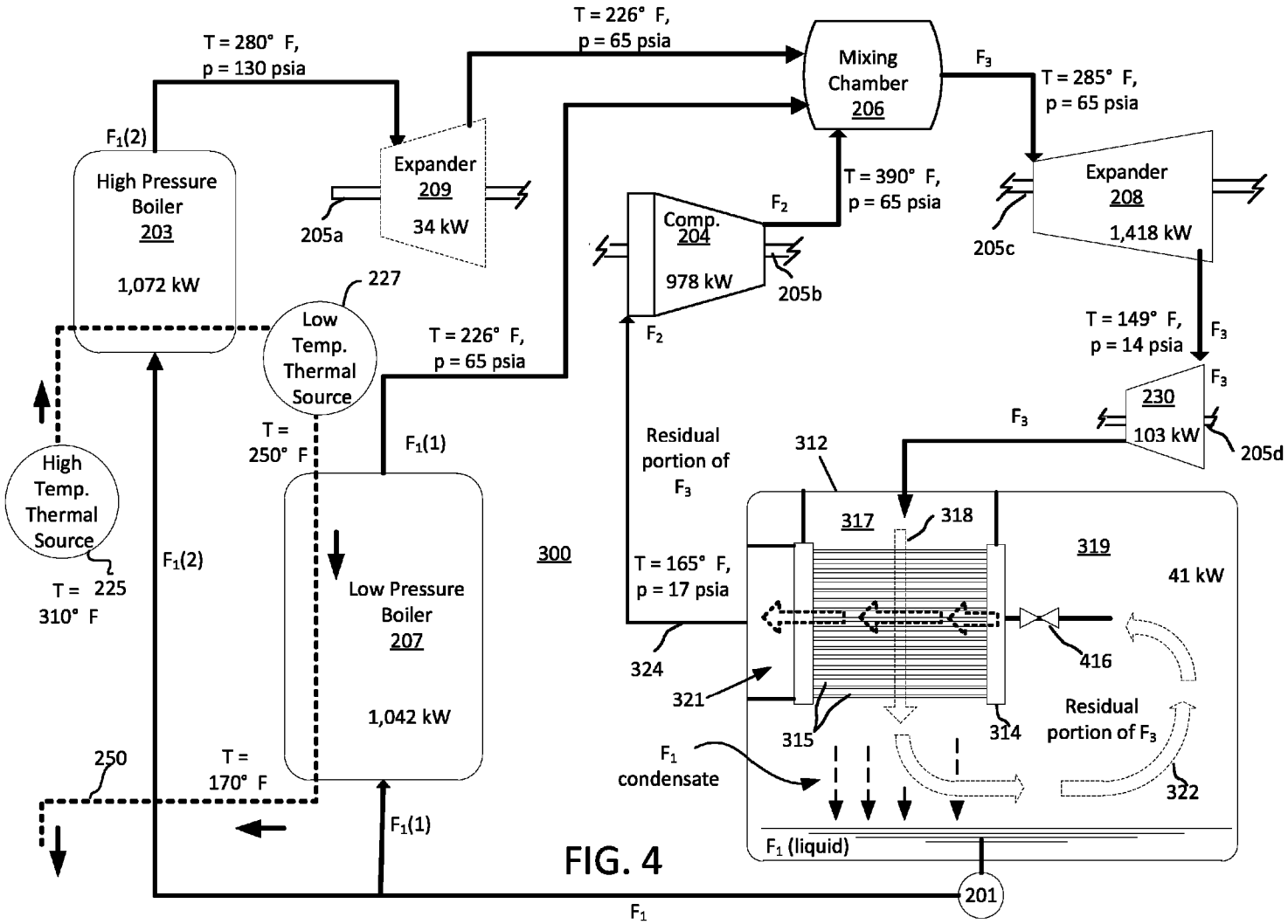
FIG. 4 is a drawing showing the apparatus of FIG. 3 in which notations have been added showing energy added to and extracted at each point in the system in accordance with a computer model.

A high pressure boiler 203 can use as its primary heat source a supply of steam from the high temperature thermal source 225. For example, the high temperature thermal source can be a geothermal well or waste heat from some high temperature process or other power generation system. The low temperature thermal source can be a thermal source that is entirely independent of the high temperature thermal source 225. However, it can be advantageous to select the low temperature thermal source 227 to be a down-line flow from the high temperature thermal source 225, after such flow has provided a portion of its thermal energy to the high pressure boiler 203. This concept is illustrated in FIG. 2-4 by optional flow path 250. For example, if the high temperature thermal source is a geothermal well, then the low temperature thermal source 227 can be a flow of residual hot water from high pressure boiler 203, prior to returning same to the geothermal well, and after it has provided a portion of its thermal energy to the boiler 203. Another example of the potential utility of this inventive approach might incorporate the use of an exit steam line of a commercial power generation system. This could be a coal, natural gas, or nuclear power plant, as these plants commonly reject a steam and condensate mixture at energy states commensurate with geothermal wells. Still, the invention is not limited in this regard and any other suitable heat sources can be used for this purpose.

The high pressure boiler 203 will have a higher pressure compared to low pressure boiler 207. However, it should be appreciated that high pressure boiler 203 can actually have a relatively low pressure as compared to those operating pressures which are normally used to provide efficient operation of a conventional heat engine. For example, in conventional heat engines, high pressure boilers typically are understood as boilers that operate in the range of 1000 to 3000 psi. In contrast, the high pressure boiler 203 can operate at a pressure in the range of 300 psi or less. Still, the invention is not limited in this regard and the actual operating pressure in the high pressure boiler 203 and low pressure boiler 207 can vary in accordance with the available heat source and other design conditions.

Referring again to FIG. 2, a first working fluid $F_1$ (in liquid form) is pressurized using a pump 201. A first flow $F_1(1)$ of the working fluid $F_1$ fluid is communicated to the interior of low pressure boiler 207. The low pressure boiler 207 has a relatively low internal pressure as compared to the high pressure boiler 203. In a preferred embodiment, the pressure within the low pressure boiler is controlled so that it is approximately equal to a vaporization pressure of $F_1$ at a temperature corresponding to the low temperature thermal source 227. The temperature in the low pressure boiler 207 is determined by the low temperature thermal source 227. The relatively low pressure and relatively low temperature within the low pressure boiler 207 facilitates vapor formation (sometimes referred to herein as $F_1(1)$ vapor). In this way, the $F_1(1)$ working fluid can effectively scavenge heat available from the source at a lower temperature (e.g., the temperature associated with the low temperature thermal source 227). In this way, the $F_1(1)$ working fluid effectively scavenges heat from low temperature thermal source 227, which thermal energy would not otherwise be considered useful for purposes of performing work. The $F_1(1)$ vapor from the low pressure boiler 207 is communicated to a mixing chamber 206 (sometimes referred to herein as a mixer), which will be discussed below in further detail. The $F_1(1)$ vapor will contain a certain amount of thermal potential energy (heat energy) when it enters into the mixing chamber 206.

A second flow $F_1(2)$ of a first liquid working fluid $F_1$ is also pressurized using the pump 201. The pressurized fluid is communicated to the high pressure boiler 203 which is maintained at a relatively high temperature as determined by high temperature thermal source 225. The high pressure boiler 203 will add a predetermined amount of thermal energy to the $F_1(2)$ working fluid. As a result of these operations, the $F_1(2)$ working fluid is converted to a vapor (sometimes referred to herein as $F_1(2)$ vapor). Thereafter, the $F_1(2)$ vapor is optionally communicated to an expander 209 where the thermal energy contained in the $F_1(2)$ vapor is optionally used to perform work. As explained above in relation to FIG. 1, the use of an expander at this stage in the cycle can potentially offer advantages under certain operating conditions. When modeling suggests that such advantages can be realized by the use of the expander 209, then its use is preferably included within the system. Still, a designer may choose to omit the expander 209 in some embodiments. The $F_1(2)$ vapor, which will still contain some thermal energy, is subsequently communicated to the mixing chamber 206.

Within the mixing chamber 206, the $F_1(1)$ vapor, $F_1(2)$ vapor are mixed with a vaporous flow of working fluid $F_2$ which has been compressed in compressor 204. These three separate vaporous fluid flows comprised of $F_1(1)$, $F_1(2)$ and $F_2$ are combined or mixed to form a vaporous mixture which is referred to herein as third working fluid $F_3$ (or $F_3$ vapor). Due to this mixing of the working fluids, the transfer of thermal energy between the fluids is facilitated. In some embodiments, additional thermal energy can optionally be provided from an independent source to the $F_3$ vapor contained in the mixing chamber 206. For example, the additional thermal energy can be provided to the mixer from a source that is external to the system shown in FIG. 2.

It is not necessary for all thermal energy transfer between the $F_1(1)$, $F_1(2)$ and $F_2$ vapor to occur within the mixing chamber 206. In some embodiments of the invention, a portion of such transfer can occur after the $F_3$ vapor exits the mixing chamber. For example, in an embodiment of the invention, at least a portion of such transfer can continue occurring as the $F_3$ vapor continues through an expansion cycle discussed below. Also, it is possible for the $F_1(1)$, $F_1(2)$ vapor, and the $F_2$ vapor fluids to enter the mixer at approximately the same temperatures and pressures. However, as a result of the different chemical compositions of such fluids, transfer or exchange of thermal energy as between them, can still potentially take place in a subsequent expansion cycle. Details of the expansion cycle are discussed below with regard to expander 208.

Significantly, the thermal transfer described herein occurs directly between the mixed working fluids $F_1(1)$, $F_1(2)$, $F_2$ and not across physical boundaries such as a thermally conductive wall of a heat exchanger (as would be the case if a conventional heat exchanger was used for this purpose). Consequently, the transfer of thermal energy between the $F_1(1)$, $F_1(2)$, and $F_2$ vapor can occur in a way that is substantially instantaneous, and highly efficient. In effect, this process provides a heat exchanger without the presence of physical walls separating the fluids that are exchanging heat (i.e. a wall-less heat exchanger).

The mixing chamber 206 receive a vaporous fluid volumetric flow of $F_1(1)$ at pressure $p_{1(1)}$, a vaporous fluid volumetric flow of fluid $F_1(2)$ at pressure $p_{1(2)}$, and a vaporous fluid volumetric flow of fluid $F_2$ at pressure $p_2$. In some embodiments, the pressures $p_{1(1)}$, $p_{1(2)}$ and $p_2$ are substantially the same pressure. In an embodiment of the invention, the volume of the mixing chamber is not restrictive with respect to the flow of fluids $F_1(1)$, $F_1(2)$ and $F_2$. Accordingly, the volume of the mixing chamber can be selected to be $V_{F1(1)}+V_{F1(2)}+V_{F2}=V_{F3}$ where $V_{F1(1)}$ is the volumetric flow rate of fluid $F_1(1)$; $V_{F1(2)}$ is the volumetric flow rate of fluid $F_1(2)$; $V_{F2}$ is the volumetric flow rate of fluid $F_2$, and $V_{F3}$ is the volumetric flow rate of $V_{F1(1)}+V_{F1(2)}+V_{F2}$ at a near constant pressure. Still, the invention is not limited in this regard and the volume of the mixing chamber 206 could be increased or decreased, thereby providing the potential to change the flow velocity and having an affect on the pressure of the third working fluid $F_3$.

The vaporous third working fluid $F_3$ is communicated under pressure from the mixing chamber 206 to expander 208 for performing useful work. A rotating output shaft 205*c* of expander 208 can be connected directly or indirectly to the rotating output shaft 205*a* of expander 209 as shown in FIG. 2. A portion of the output power from expanders 208, 209 can be used to directly or indirectly drive input drive shaft 205*b* of compressor 204. Well known conventional expander technology can be used for purposes of implementing expander 208, provided that it is capable of using a pressurized vapor to perform useful work. For example, the expander 208 can be an axial flow turbine, custom turbo-expander, vane expander or reciprocating expander. Advantageously the expander 208 will be selected by those skilled in the art to provide high conversion efficiency based on the specific thermodynamic and fluid properties of $F_3$ delivered to the expander for a particular embodiment of the cycle. Still, the invention is not limited in this regard. After such work is performed by the expander 208, the $F_3$ working fluid is communicated from the expander to a condenser 212 as hereinafter described.

The condenser 212 can be any device capable of condensing a working fluid from its vapor state to its liquid state. As is well known in the art, condensing is commonly performed by cooling the working fluid under designated states of pressure. As will be appreciated by those skilled in the art, this cooling process will generally involve a release of heat contained in the third working fluid $F_3$. In the most commonly used configurations, the cooling process is accomplished by using a heat exchanger to move the heat from the F3 fluid to the ambient environment external to the heat engine (thermal cycle). This simple configuration is shown in FIG. 2.

In an alternative embodiment a heat engine 300 can operate in a manner similar to that described above with respect to heat engine 200. However, in place of the conventional condenser arrangement, the heat engine 300 utilizes a heat exchange process that is internal to the heat engine and is therefore an integral part of the thermal cycle. As illustrated therein, the $F_3$ working fluid which exits expander 208 is communicated to a compressor 230. A portion of the output power from expanders 208, 209 can be used to directly or indirectly drive input drive shaft 205*d* of compressor 230. The compressor 230 performs work to increase the pressure of the $F_3$ working fluid as it enters the first condensing chamber 317 of condenser 312. A heat exchanger 314 within the condenser 312 forms a heat exchange system. A flow 318 of the vaporous $F_3$ fluid is allowed to pass over the exterior surfaces of the heat exchanger 314. This cools the $F_3$ fluid and thereby facilitates the condensing of the $F_1$ fluid contained within the $F_3$ fluid mixture. The $F_1$ portion therefore drops out as a liquid in the form of condensate, is collected in the condenser as $F_1$ fluid (liquid), and is available for reuse. This process leaves a residual portion of the $F_3$ working fluid 322. Residual portion 322 is a remaining portion of the one or more fluids previously comprising $F_3$ that exist after the $F_1$ condensate has been extracted from $F_3$.

The residual portion 322 passes into a second condenser chamber 319 and is later used for purposes of cooling the heat exchanger 314. More particularly, a low pressure zone is provided in a plurality of flow channels 315 of the heat exchanger 314. One or more flow restrictors, expansion valves or throttles 316 can be used to effect cooling of the residual portion of the $F_3$ working fluid as it passes into the heat exchanger. Expansion valves, flow restrictors and other types of throttling means are well known in the art and therefore will not be described here in detail. However, it should be appreciated that the expansion valve (or other type of throttling means) would be sized and configured to accomplish the desired cooling, within the fluid capabilities of the flow provided.

It should be understood that the pressure within the flow channels 315 is at a lower pressure than the environment within the second condenser chamber 319. Cooling of the residual portion of the $F_3$ working fluid is accomplished as the vaporous residual portion of the $F_3$ working fluid is forced through the expansion valve 316 by means of compressor 230 and transitions from a higher pressure state to a lower pressure state. As will be understood by those skilled in the art, the expansion of the vaporous residual portion of the $F_3$ working fluid will lower its temperature. This reduction in temperature allows the residual portion of the $F_3$ working fluid in flow channels 315 to then draw heat from the flow 318 of $F_3$ working fluid (in vaporous state) which surrounds and circulates past the flow channels 315 and/or exterior of the heat exchanger. The foregoing process results in extraction of $F_1$ condensate from the $F_3$ working fluid as shown. The residual portion of $F_3$ subsequently enters a third chamber 321 of condenser 312 where it is used as the second working fluid $F_2$.

It will be appreciated that in FIG. 3 the residual portion 322 is essentially functioning as a refrigerant and in this role scavenges available heat from the flow 318 of $F_3$. This process concentrates the available thermal energy in the residual portion 322 (after the residual portion passes through the expansion valve 316) and this thermal energy can thereafter be used within the cycle to perform useful work. Stated differently, the process has the potential to move a portion of heat from $F_3$ to $F_2$. This heat is further combined with the compression heat of $F_2$ in compressor 204. The result of compression process 204 is the ability to increase the temperature of the overall mixture in 206 at the same time as providing drive pressure to the overall $F_3$ flow. This is of value because the $F_1(1)$ and $F_1(2)$ fluids can arrive at the mixing chamber 206 at or near saturation, and it is beneficial to start the expansion process at a temperature and pressure condition that is above the saturation line.

In FIG. 3, the compressor 230 is disposed on input side of expansion valve 316 to provide the required pressure differential. However, those skilled in the art will understand that compressor 230 could instead be provided at condenser outlet 324 to reduce the pressure in third condenser chamber 321 and in the flow channels 315. The resulting pressure reduction in these zones could then be used to provide the required pressure differential across the expansion valve 316. In the limit of the design it is possible to comprise a configuration where the compressor 230 is not incorporated at all. In that case, the high pressure side of the heat exchanger is simply the exit of the expander 208 and the low pressure side of the heat exchanger is afforded by the compressor 204. This being the simplest configuration that is possible.

Based on the foregoing disclosure it will be understood that the condenser process used for the present invention can be effected using the conventional condenser arrangement shown in FIG. 2, the condenser arrangement shown in FIG. 3, or any other suitable condensing arrangement. For example, in some embodiments, it can be advantageous to utilize a conventional condenser as shown in FIG. 2, together with a condenser arrangement as shown in FIG. 3. More particularly, it is possible to integrate both of the condensing configurations into a unified apparatus that best suites the needs of a particular (heat engine) configuration. In such embodiments, the residual portion of $F_3$ that remains in each condensing unit (after the extraction of $F_1$ condensate) can be combined for use as $F_2$ working fluid. The specifics of a particular design are reliant on many factors, including the properties of the constituent fluids, the flow rates of the fluids, the ratios of the fluids, the condenser pressure and temperature, and hardware or apparatus physical configuration. These are all common variables that are well understood by those skilled in the art of condenser designs.

The temperature and pressure conditions inside the condenser 212, 312 are chosen so that the $F_1$ constituent part of $F_3$ is converted to a condensate within the condenser, while the second working fluid $F_2$ is not condensed. In other words, a residual portion of $F_3$ will remain in a vaporous state. This residual portion of $F_3$ is later used as the second working fluid $F_2$. Those skilled in the art will appreciate that this condensing process applied for purposes of separating $F_1$ from the residual portion of $F_3$ can be accomplished by choosing the first and second working fluid to have different thermal properties.

In conventional Rankine cycle heat engines, the condensers can often be the most constraining part of the system. This is because it is necessary to completely condense 100% of the vapor that comprises the working fluid. Because of the difficulty in accomplishing 100% condensate, many systems will bleed a portion of the working fluid outside of the main system. This bleed process may include directly releasing working fluid to the atmosphere or to an independent reservoir that is outside of the primary condenser of the system. A key advantage of the current invention is the ability to not require a full condensate process. Accordingly, condenser 212/312 may not actually condense 100% of $F_1$ from the vaporous $F_3$ mixture. Advantageously, this condition is acceptable for purposes of the present invention, and a portion of $F_1$ can be permitted to remain mixed within a residual portion of $F_3$. For purposes of the present description, any portion of the residual $F_1$, either in the vapor or liquid form (carried in the fluid stream), after the condensing process, therefore remaining in $F_2$), can be considered a constituent of $F_2$ by design. With the $F_1$ condensate and the residual portion of $F_3$ available within the condenser in this way, the process has essentially returned to its starting point, with the first working fluid $F_1$ in a liquid form, and the second working fluid $F_2$ in a vaporous state. Thereafter, the entire process described above can be repeated in a continuous cycle.

The invention has been described herein with respect to a high pressure boiler 203 and a low pressure boiler 207. As such, two boil-off points are established and used to more efficiently perform work utilizing the available thermal energy from the heat source. Although only two boilers are included in the embodiments shown herein, it should be understood that the invention is not limited in this regard. It is contemplated that additional boilers can be used to provide additional boil off points, where each boiler operates at a predetermined temperature and pressure to transport heat to a corresponding flow of the first working fluid. For example, a system could utilize a low pressure boiler, medium pressure boiler, and high pressure boiler. More generally, at least a third flow of the first working fluid can be communicated to a third pressure boiler to produce a third flow of first working fluid vapor at a pressure different from the low pressure boiler and the high pressure boiler. The third pressure boiler will use a thermal source having a temperature different as compared to the low temperature thermal source and the high temperature thermal source. Systems with four or more boilers are possible and may be desirable under certain operating conditions as will be apparent to those skilled in the art. The resulting vapor from each boiler can be subsequently transported to the mixing chamber where a transfer of thermal energy can occur as previously described.

An example of the operation of exemplary heat engine 300 will now be provided with reference to FIG. 4. The operation of heat engine 300 as described herein is based on computer modeling. It should be appreciated that the invention is not limited to the working fluids and/or to the temperatures, pressures and/or mass flow rates that are stated herein. For purposes of this computer model it will be assumed that the first working fluid $F_1$ is methanol and the second working fluid $F_2$ is a mixture of helium, nitrogen and methanol. More particularly, the mixture is chosen to contain 1 part helium, 7 parts nitrogen, and 2 parts methanol by weight. The following flow rates are assumed:

$F_1(1)$=2 lbs/s $F_1(2)$=2 lbs/s $F_2$=10 lbs/s (7 lbs/s nitrogen, 1 lb/s helium, 2 lb/s methanol)

$F_3$=14 lbs/s

For this example we assume that the high temperature heat source temperature is 310° F. and that the heat added to working fluid $F_1(2)$ in the high pressure boiler 203 is 1072 kW. This produces high pressure $F_1(1)$ vapor at the output of the high pressure boiler 203 at a temperature of 280° F. and a pressure of 130 psia. This high pressure vapor is used to perform 34 kW of work in expander 209. The vapor exits the expander 209 at relatively low pressure and temperature (T=226° F., p=65 psia).

An outflow of the heating process at high pressure boiler 203 provides the low temperature thermal source 227 at a temperature of about 250° F. The low temperature thermal source is used to provide thermal energy to the low pressure boiler 207 where 1,042 kW is added to the $F_1(1)$ working fluid. This produces low pressure $F_1(1)$ vapor at the output of the low pressure boiler (T=226° F., p=65 psia). An outflow of the heating process at low pressure boiler 207 is returned to the source, such as a geothermal well, at a temperature of about 170° F.

Concurrent with the foregoing vaporization steps, the $F_2$ working fluid is compressed in compressor 204. The $F_2$ working fluid is also heated as a result of being compressed. In the exemplary model, the $F_2$ working fluid enters the compressor 204 at a temperature of 165° F. and a pressure of 17 psia. The compressor uses 978 kW of power to perform the compressing operation, which results in the $F_2$ working fluid exiting the compressor at a temperature of 390° F., and a pressure of 65 psia. The process continues as described with $F_1(1)$, $F_1(2)$, and $F_2$ being mixed in the mixing chamber 206 to form $F_3$ working fluid. The $F_3$ working fluid is subsequently delivered to the expander 208, where it can perform 1,418 kW of work. As noted above, an output shaft of expander 208 can be connected directly or indirectly to compressor 204, so that a portion of this work output can be used to drive compressor 204. After the $F_3$ working fluid has been used to perform useful work, it exits the expander 208 at relatively low pressure and temperature (T=149° F., p=14 psia) and is communicated to compressor 230. Compressor 230 uses 103 kW of power to pressurize the $F_3$ working fluid before the working fluid enters the condenser.

The condensing process effectively results in the separation of the $F_1$ working fluid from the $F_2$ working fluid as previously described. The $F_2$ vapor produced by the condenser 312 has a relatively low temperature and pressure (T=165° F., p=17 psia). The $F_1$ working fluid is pressurized by liquid pump 201 for transport to the low pressure boiler 207 and the high pressure boiler 203. Approximately 41 kW of power is consumed by pumping (e.g. pump 201) and by other mechanical systems losses. These losses are simplistically represented in FIG. 3 as losses associated with the condenser 312.

Given the foregoing assumptions, a tabular representation of the model in FIG. 4 is presented below in Table 1:

TABLE 1

| | | |
|---|---|---|
| Heat Added in High Pressure Boiler | $Q_{in\ HP}$ = | 1,072 kW |
| Heat added in Low Pressure boiler | $Q_{in\ LP}$ = | 1,042 kW |
| Work of Compression | $W_{in}$ = | 1,081 kW |
| Work Extracted | $W_{out}$ = | 1,452 kW |
| Pumping & Mechanical Loss | $W_{pump}$ = | 41 kW |
| Net Work | $W_{Net}$ = | 330 kW |
| Cycle Efficiency | $\eta_{th}$ = | 15.6% |

Notably, computer modeling shows that a total of 330 kW of power can be extracted from the relatively poor quality thermal source in this example. In contrast, a conventional Rankine cycle utilizing the same heat source geothermal vapor at the same temperature (310° F.), and using only a single boiler, could only extract about 136 kW. In this regard it may be noted that the efficiency for such a conventional Rankine Cycle under these conditions would be 12.7%. Accordingly, the present invention has the potential to produce a substantially larger amount of power by extracting larger quantities of thermal energy from same, relatively poor quality thermal source (i.e., relatively low temperature) as compared to more conventional commercial power systems.

The heat engine 200 and its associated cycle described in FIGS. 1-4 can be optimized based on the choice of working fluids internal to the cycle, in concert with selection of the most appropriate chemical configurations of the fluids. For example, $F_1$ and $F_2$ are advantageously comprised of chemical compositions such that during the course of the cycle, $F_1$ transitions between a liquid and vapor and $F_2$ remains dominantly vapor (it being understood that a portion of liquid may reside in a vapor stream when the vapor stream is saturated). However, the invention is not limited in this regard, and it is also possible to operate the cycle with many chemically unique constructs comprising different mixing ratios thereof.

The heat cycle described with respect to FIGS. 1-4 has many advantages over conventional systems. For example, the cycle provides higher thermal transfer rates which are made possible by having the working fluids function as the heat exchanger (or act in the capacity of a heat exchanger). This technique is utilized in all of the various embodiments to facilitate transfer thermal energy between $F_1$ and $F_2$. A further advantage is gained in the present invention by selecting the fluid chemical properties, physical properties, and fluid temperatures/pressure within the cycle such that the latent heat of vaporization is used for thermal exchange purposes. In particular, the high pressure boiler 203 can at least provide the first working fluid ($F_1$) with thermal energy equal to the latent heat of vaporization for such working fluid. Those skilled in the art will appreciate that liquid to vapor transformations provide very high thermal capacity. A similar advantage can be gained in low pressure boiler 207 where relatively low pressure conditions are maintained to facilitate vaporization of the respective working fluid at relatively low temperature. The latent heat of vaporization thus acquired by the respective working fluids in each case can provide both higher motive capacity and higher thermal capacity to improve power production efficiencies.

The cycle and associated apparatus described with respect to FIGS. 1-4 has the potential to increase the conversion efficiency of certain heat resources (e.g., heat resources of less than 800° F.). More particularly, the cycle has the potential to increase conversion efficiency for heat resources having temperatures less than 400° F. Significantly, the present invention can potentially facilitate power generation from such relatively low temperature sources at efficiency levels that are competitive with heat sources based on hydrocarbon energy resources (which typically are at a much higher temperature). One aspect of the invention that permits this important result involves mixing the volumes of the fluids $F_1$ and $F_2$ (in vapor state). The process of combining the two vapors facilitates providing relatively large quantities of available energy to the expander 208. Note that the Rankine portion of the cycle (pump 201, high pressure boiler 203, optional expander 209 and expander 208) alone creates a lesser amount of available vapor volume (relative to the substantial amounts of heat energy added) but, this fluid transports very large quantities of thermal capacity. Conversely, the Brayton portion (compressor 204, mixing chamber 206, second expander 208, condenser 212, 312) alone has large volumetric capacity but less effective or less efficient thermal exchange capacity, relative to the source of heat. The resulting combination of thermal capacity and volumetric capacity enable a larger potential to extract work for each unit of thermal energy added.

In the present invention, a large quantity of heat energy is extracted from the high temperature thermal source 225 by means of vaporization. The latent heat of vaporization provides a useful method for converting very large quantities of heat in the $F_1$ liquid into kinetic energy residing in the vapor. Still, the ability of the vaporous fluid to perform work and therefore create power is constrained by the overall volume that is created (relative to the heat that is consumed in creating that volume). In order to overcome this limitation, it is advantageous to have a large volume second working fluid ($F_2$) that facilitates the process of producing the actual power.

Providing a large volume second working fluid in vaporous form presents another challenge. In particular, vaporous fluids tend to be difficult to heat by heat exchanger means, as such devices are governed by principles of convection. The invention overcomes the limitations of the prior art, and facilitates improved efficiency by moving large quantities of thermal potential energy to the first working fluid $F_1$ (in the Rankine portion of the cycle), and then transferring this thermal energy directly to the second working fluid $F_2$ (in the Brayton portion of the cycle) by mixing the first and second working fluids. Notably, a Brayton cycle and a Rankine cycle each has the capability to convert thermal energy to power at a relatively low efficiency (typically less than 15% assuming 400° F. is the heat source temperature). However, by combining the methods of these independent cycles, where the best features of each is utilized, it is possible that the resulting cycle efficiency can be increased.

In the embodiments shown in FIGS. 1-4, efficiency of the cycle is enhanced by making maximum use of available heat from a thermal source. In certain scenarios, the high pressure boiler 203 can use as its primary heat source a supply of steam (e.g. from a geothermal well) which, after use becomes a down-line flow of residual hot water. The residual hot water is conventionally understood as being not useful for purposes of performing work. But in the present invention this residual hot water is used to vaporize a flow of working fluid by means of low pressure boiler 207. In this case the heat is extracted from the low temperature thermal source 227 by maintaining a relatively low pressure environment within the low pressure boiler 207 (thereby lowering the temperature at which the $F_1(1)$ working fluid will vaporize) and by lowering the temperature of $F_1(1)$ as it transitions into such low pressure environment (thereby enabling the F1(1) working fluid a greater capacity to absorb available thermal energy. This enables a portion of the normally rejected or unused thermal energy from the source to be introduced within the cycle, at a location where it is capable of being used to perform work.

In general, the cycle described in FIGS. 1-4 will be configured based on the nature or type of thermal source available for providing thermal energy. From there, appropriate fluid mixtures are selected and modeled using computer simulation tools. The operation and control of the cycle is then fine tuned around desired control points of temperature and pressure within the apparatus of the system configuration chosen. These temperatures and pressures are dominantly controlled by altering the fluid flow rates of the individual working fluids of certain fluid combinations at select points within the cycle.

In the embodiments shown in FIGS. 1-4, the temperature of $F_1(1)$ and $F_1(2)$ are generally controlled by selecting the source temperature used for boilers 203, 207 and/or controlling the flow rate of the working fluid. The pressure of the working fluids $F_1(1)$ and $F_1(2)$ supplied to the boilers 203, 207 is controlled by pump 201. Accordingly, the initial pressure levels of $F_1(1)$ and $F_1(2)$ can be controlled by the pump 201, and valve operable means that are common in the art of power systems. Conventional pressure regulators can be used to manage (control) the pressure in high pressure boiler 203 and low pressure boiler 207.

In FIGS. 2-4, the temperature and pressure of working fluid $F_2$ is generally controlled by the operation of compressor 204. Accordingly, compressor 204 is preferably designed to raise the temperature and pressure of $F_2$ to a suitable level so that it enters the mixing chamber 206 at approximately the same pressure as F1(1) and $F_1(2)$. Specific designs of the mixing chamber would allow for or enable deviations in pressures between these fluids, and are intended to be included within the scope of the present invention.

The pressure, temperature and construct of the heated working fluid mixture $F_3$ entering the expander is key for establishing the performance capability of the cycle. These factors include the constituent mass flow rates and therefore establish the parameters for the expansion rate and the design requirements of the expander 208. It is further understood that the expander performance is highly dependent on the energy content and expansion profile of the $F_3$ flow. It would be understood by those skilled in the art that the volumetric flow rate, density, pressure, and temperature can be used to establish the performance characteristics and therefore provide the basis for the best expander design. These parameters can be established and controlled within the cycle construct for a broad range of applications where the cycle is designed around the available thermal source temperature and heat rate.

The mixing ratio of $F_1$ and $F_2$ contained within the $F_3$ flow can be either static or dynamic. Static fluid mixing involves mixing the $F_1$ working fluid (i.e, $F_1(1)$, $F_1(2)$) with the $F_2$ working fluid at a fixed rate. In other words, a fixed mass flow rate is used for each working fluid under set conditions of temperature and pressure. In such an embodiment, the dynamics of each working fluid remains at a near steady state, with the input thermal energy set at a near constant rate, and a constant or substantially constant output (shaft mechanical energy). The ability to dynamically alter the flows and mixtures facilitates control of the cycle relative to deviations in heat addition and/or power extraction. Dynamic fluid mixing involves mixing the working fluids at variable rates. For example, such dynamic mixing might be implemented for purposes of controlling the operational dynamics of such an engine system. In such a dynamic fluid mixing implementation, the state conditions of temperature, pressure, and mass flow for each working fluid may be fluctuating dynamically as a function of fluctuations or changes within the operating cycle. In those instances where the input (thermal) energy is being changed in conjunction with load levels (i.e. power output levels), it can be more appropriate in some embodiments to change the relative mass flow rates of $F_1$ and $F_2$ rather than changing the gross overall flow rate as a set mixture (or fixed mixture ratio). If the mass flow rate of $F_1$ is changed, this change can be implemented by varying the flow rate of $F_1(1)$, $F_1(2)$ or both. Still, the invention is not limited in this regard, and the gross overall flow rate of $F_3$ can be changed with a fixed mixture ratio. In yet a further alternative embodiment, the mixing ratio of $F_1$ and $F_2$, and the overall flow rate of $F_3$, can be changed.

In very general terms, the ratio of first working fluid $F_1$ to second working fluid $F_2$ contained in $F_3$ would be about ⅓ (one-third) to ⅔ (two-thirds) in an embodiment of the invention. The ratios may in various embodiments also extend over a range. The range can extend from a first arrangement having ⅕ first working fluid to ⅘ second working fluid, to a second arrangement having ⅔ first working fluid and ⅓ second working fluid. Still, the invention is not limited in this regard.

Fluid selection for operating the configuration of thermodynamic cycles described herein is based on many interrelated factors. The conditions of operating temperature and pressure are important in selection of the chemical makeup of the fluid. It is also desirable to choose a boiling point of the first working fluid which is appropriate relative to the source temperature of available heat. For example, if the source of heat is geothermal with a temperature of 350° F., it is desirable to have a first working fluid $F_1$ that has the capability to absorb heat from the source thru vaporization of the selected working fluid at a rate that is commensurate with both the heat rate of the source and the size of the desired system. It is further desirable to select $F_1$ so that it can re-condense to liquid in the condenser efficiently relative to the condensate cooling that is available. For example, $F_1$ can be chosen to be propane in some embodiments since it changes from a liquid to a vapor at lower temperatures than other working fluids, such as pentane (assuming the same operating pressure). This configuration would be appropriate where there is a large supply of a cooling medium (such as cold water) that is readily available. Fluid choices are also governed by the latent heat value and heating capacity of the constituent working fluids.

Use of some fluids as the first working fluid can also be a disadvantage in the present invention. For example, working fluids with extremely low volumetric expansion potential may not be the best choice for use in the present invention. Also, certain fluids that have higher boiling points and good volumetric expansion capabilities may only operate at temperatures that are above the source temperature. Accordingly, such fluids would be ruled out for a lower temperature source, but may perform well for another configuration with a higher temperature thermal source. There may be fluids that that perform well in some parts of the cycle, but may not perform well in the other parts of the cycle. Accordingly, it is important to select and match the fluid capability with the characteristics of the thermal energy source.

The first and second working fluids, and ratios thereof, should also be selected such that they work in concert with one another. In particular, the more rapid cooling of the second fluid (as compared to the first fluid) during the expansion process can facilitate the exchange of energy from the first fluid to the second fluid. This leaves the first fluid very close to the vapor to liquid transition point as it approaches the end of the expansion cycle. As the first working fluid condenses, it is therefore separated from the second working fluid and can be collected in the condenser. This unique fluid capability provides the means to tune the thermal take-up rates (heat addition/vaporization) and additionally the drop-out rates (condensate rates) of the fluids in operation.

In one example of the invention, $F_1$ can be water, and $F_2$ can be a mixture comprised of nitrogen, helium and water vapor. Since $F_1$ is water in this example, mixing of $F_1$ and $F_2$ will result in a fluid $F_3$ which is also a mixture of nitrogen, helium, and water. The difference between the two fluids $F_2$ and $F_3$ is that $F_3$ will have a higher percentage of water vapor as compared to $F_2$. Still, the foregoing is merely one example of fluids that could be selected for use as $F_1$, $F_2$ and $F_3$. Similar effects can be achieved using alternative fluid combinations. In one embodiment, the water in the example could be replaced with methanol, pentane, or ammonia to achieve the same phenomena at lower temperatures. In such a scenario, helium could still be used as a constituent of $F_2$, or as an alternative, argon, hydrogen or neon could be used instead. Still, the invention is not limited to these particular fluids.

Figure 5:
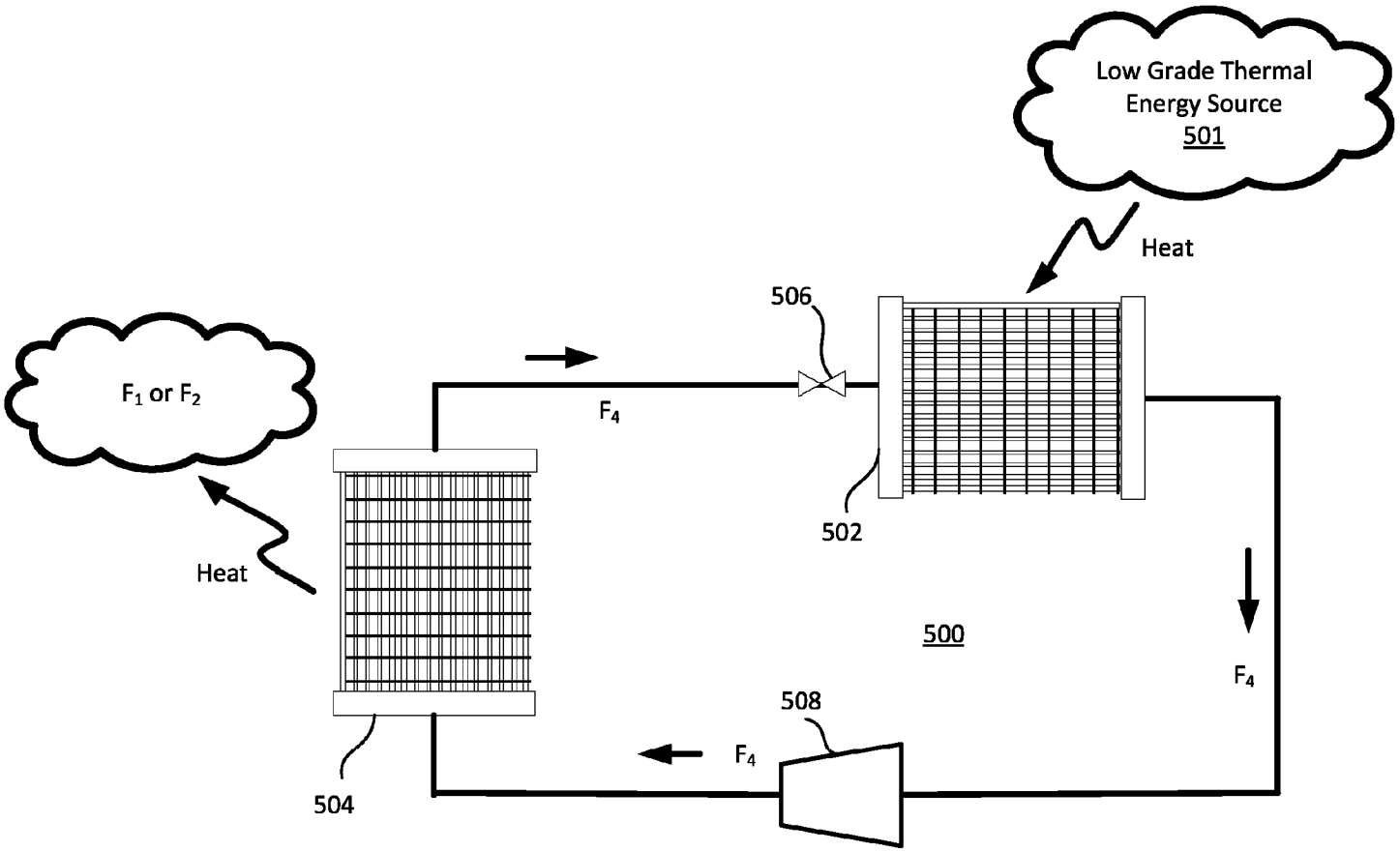
FIG. 5 is a drawing that is useful for understanding an independent refrigeration loop which can be used with the present invention.

Referring now to FIG. 5, there is shown an independent refrigeration loop 500 which can be used in combination with the inventive arrangements to provide further performance enhancements. The refrigeration loop 500 uses a fourth working fluid $F_4$ to transfer thermal energy to $F_1$ or $F_2$ from an available thermal energy source. The available thermal energy source can be any source of thermal energy that is readily available. According to one aspect of the invention, the available source of thermal energy can be a low grade thermal energy source. As used herein, a low grade thermal energy source is one that inherently produces or rejects large quantities of low grade heat at a relatively low temperature. For example, in some embodiments of the invention, a low grade thermal energy source can produce thermal energy at a temperature of between about 150° F. to 300° F. In other embodiments of the invention, a low grade thermal energy source can produce heat at a temperature range between 300° to 800° F. Still, the temperature range of a low grade heat source as described herein can be higher or lower than the stated ranges without limitation. Those skilled in the art will appreciate that the cycles and systems described herein can be adjusted as needed to accommodate the operating temperatures of a particular low grade thermal energy source which is available. The low grade thermal source can exist within, or external to, the hybrid thermal cycle described with respect to FIGS. 1-4. In other words, the thermal energy can be scavenged from a portion of the hybrid thermal cycle described herein or can be derived from a source that exists independent of such cycle. The refrigeration loop shall be briefly described with respect to FIG. 5, after which the application of such loop to the various embodiments shall be explained in further detail in FIGS. 6A-6E and FIG. 7A-7C.

In refrigeration loop 500, the fourth working fluid $F_4$ is communicated to an expansion valve (or throttle) 506. The fourth working fluid can be a chemical substance that is the same or different as compared to the chemical composition each of said first, second and third working fluids. Cooling of the $F_4$ working fluid is accomplished as the $F_4$ working fluid is drawn through the expansion valve 506 by means of compressor 508. In particular, cooling occurs as the $F_4$ fluid transitions from a higher pressure state to a lower pressure state. As will be understood by those skilled in the art, the expansion of the $F_4$ working fluid will lower its temperature. Expansion valves, flow restrictors and other types of throttling means are well known in the art and therefore will not be described here in detail. However, it should be appreciated that the expansion valve (or other type of throttling means) would be sized and configured to accomplish the desired cooling, within the fluid capabilities of the flow provided. In some embodiments of the invention, the $F_4$ working fluid is communicated to flow channels within the heat exchanger 502, thereby allowing the fluid to draw heat from the low grade thermal energy source 501. After the $F_4$ working fluid has absorbed heat from the low grade thermal energy source, it flows to compressor 508 where the fluid is compressed. After exiting the compressor 508, the $F_4$ working fluid is communicated to heat exchanger 504. At heat exchanger 504, a portion of the heat contained within the $F_4$ working fluid is communicated to the F1 or F2 working fluid within system 200 or 300. The low grade thermal energy source 501 shall now be described in further detail with respect to FIGS. 6A-6C.

In some embodiments of the invention, the $F_3$ working fluid in FIGS. 1-4 can serve as the low grade thermal energy source 501. In such embodiments, thermal energy contained within the $F_3$ working fluid is transferred to the $F_4$ working fluid by a process involving the heat exchanger 502. In a preferred embodiment, this process involves extracting thermal energy from $F_3$ contained within the condenser 212. As explained below, such an arrangement can be advantageously used as part of the condensing process to separate $F_1$ working fluid from $F_3$ working fluid. Several different configurations are possible for purposes of extracting heat energy from $F_3$ working fluid. Each of these processes will be described below in further detail.

Figure 6A:
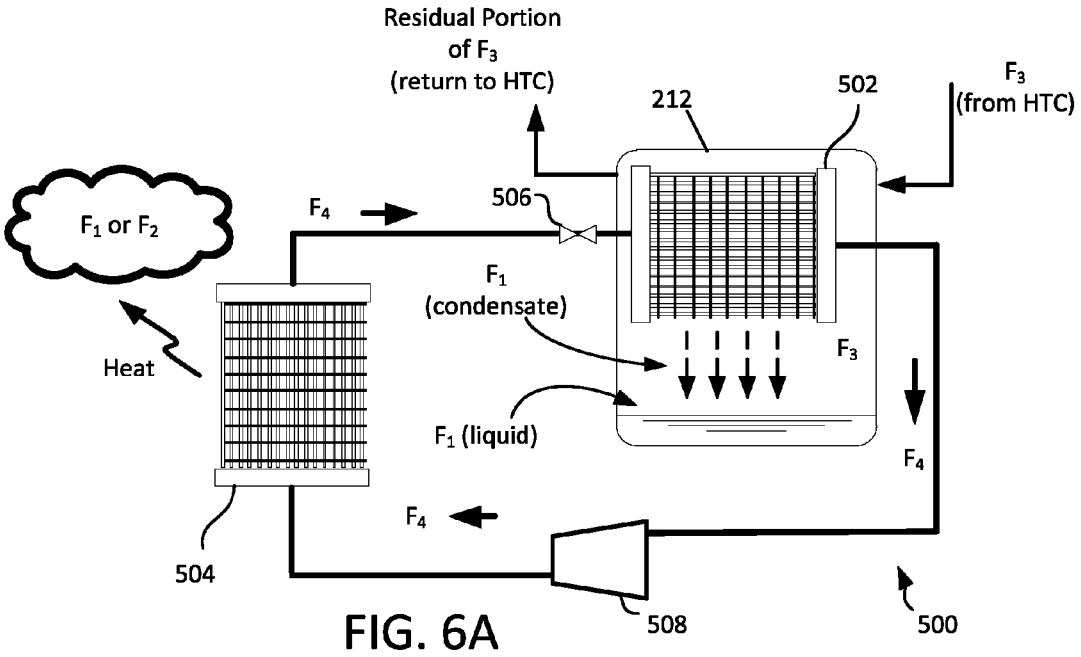
FIGS. 6A-6E are drawings useful for explaining several configurations which facilitate acquisition of thermal energy by the cooling loop of FIG. 5.

In a first exemplary embodiment shown in FIG. 6A, the heat exchanger 502 can be disposed completely or partially within the condenser 212. In such an embodiment, $F_4$ working fluid absorbs heat from the $F_3$ working fluid contained within the condenser 212. More particularly, the $F_3$ working fluid flows around the exterior of the heat exchanger 502 and/or between the flow channels (not shown) of the heat exchanger, which contain cooled $F_4$ working fluid. The heat exchanger 502 facilitates thermal energy absorption by the cooled $F_4$ working fluid. This process cools the $F_3$ working fluid in the condenser, thereby aiding in the production of a condensate comprised of the $F_1$ working fluid. Thereafter the $F_1$ working fluid (condensate) can be re-used in the hybrid thermal cycle as previously described. In this first embodiment, the $F_3$ working fluid serves directly as the low grade thermal energy source 501.

Figure 6B:
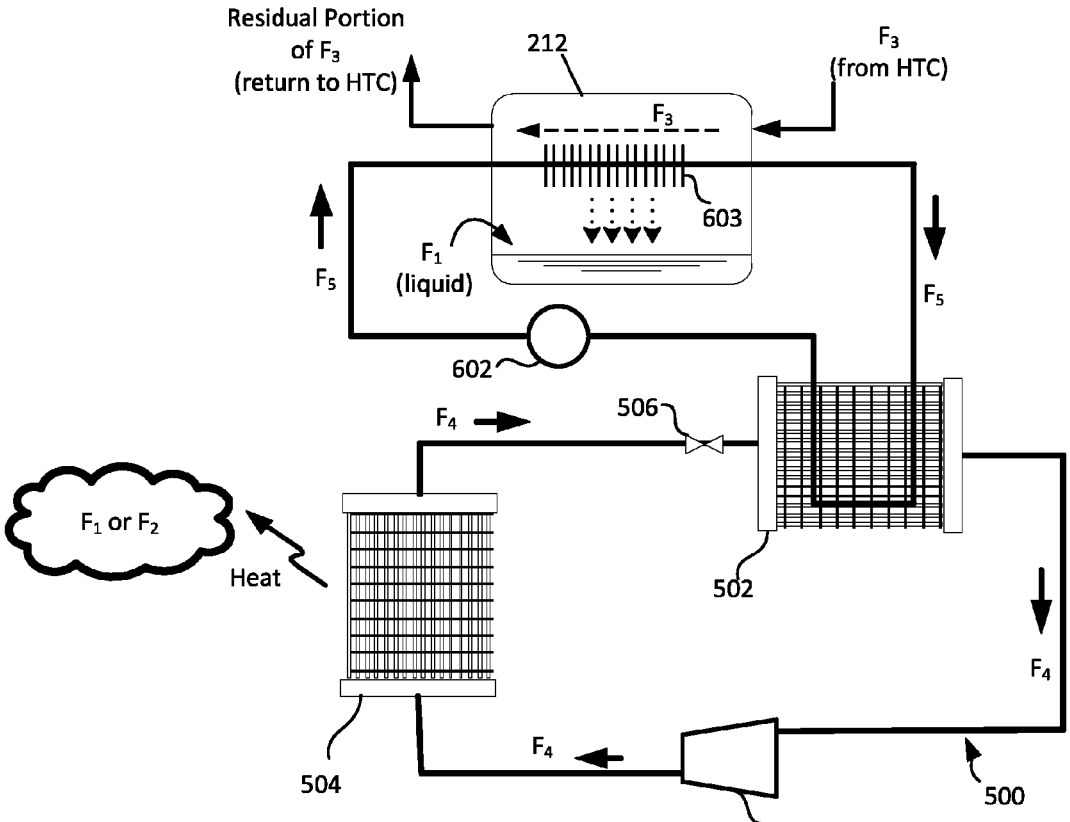

In a second exemplary embodiment shown in FIG. 6B, the heat exchanger 502 is located external of the condenser 212. A fifth working fluid $F_5$ is circulated in a closed loop by a pump 602. The pump circulates the fifth working fluid within or in close proximity to the heat exchanger 502 to cool the $F_5$ working fluid. Thereafter, the cooled $F_5$ working fluid is circulated through heat exchanger 603. Heat exchanger 603 transfers thermal energy from the $F_3$ working fluid to the $F_5$ working fluid, thereby heating the $F_5$ working fluid. This heated $F_5$ working fluid is circulated to heat exchanger 502, where it transfers the thermal energy it has acquired to the $F_4$ working fluid. In this second exemplary embodiment, thermal energy is transferred to the heat exchanger by the $F_5$ working fluid, but the F3 working fluid nevertheless serves as the low grade thermal energy source 501.

Figure 6C:
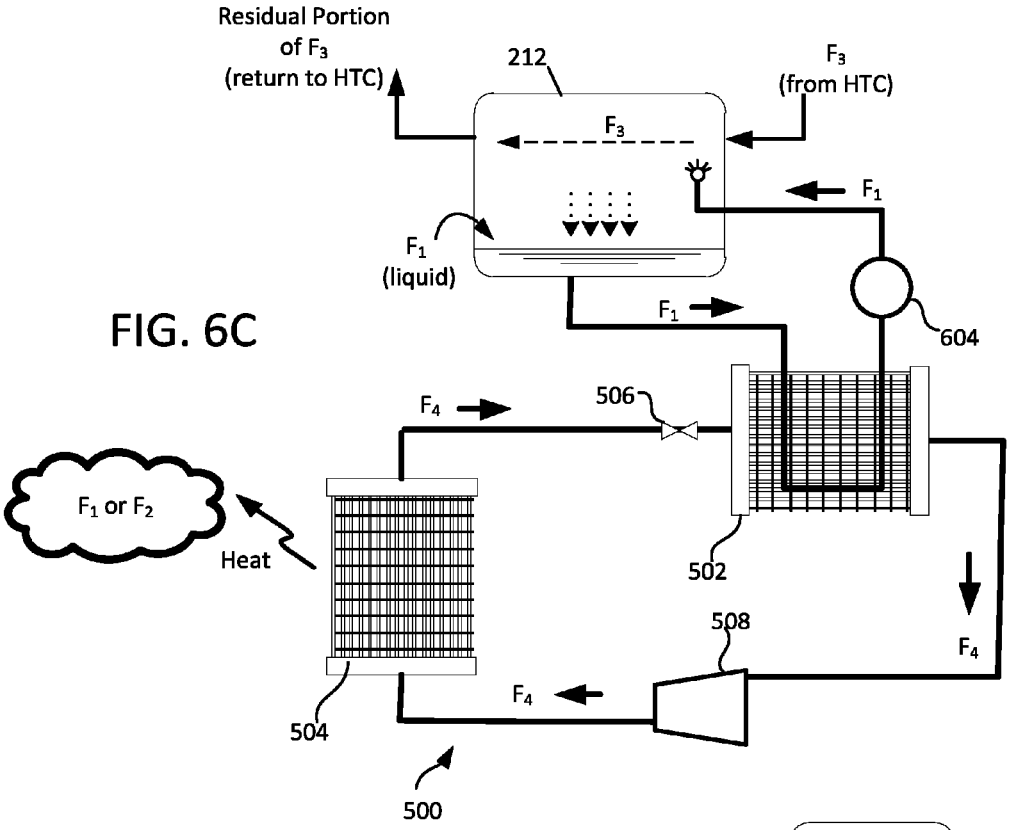

In a third exemplary embodiment shown in FIG. 6C, the heat exchanger 502 is again located external of the condenser 212. The $F_1$ condensate within the condenser (which is a constituent of $F_3$) is circulated in an open loop by a pump 604. The heated $F_1$ working fluid is circulated to the heat exchanger 502, where it transfers the thermal energy (heat) to the cooled $F_4$ working fluid. This process cools the $F_1$ working fluid. The cooled $F_1$ working fluid is then returned to the condenser 212 where the working fluid is released as a spray at the inlet side of the condenser. The spray of cooled $F_1$ liquid functions to directly cool the $F_3$ working fluid entering the condenser, thereby facilitating the process of condensing additional $F_1$ working fluid. In this third exemplary embodiment, thermal energy is transferred to the heat exchanger by the $F_1$ working fluid, but the $F_3$ working fluid serves as the low grade thermal energy source 501.

In the embodiments shown in FIGS. 6A-6C, the $F_3$ working fluid is the low grade thermal energy source, and the thermal energy from such source is provided directly or indirectly to heat exchanger 502. In an fourth embodiment shown in FIG. 6D, a low grade thermal energy source 610 exists independent of the hybrid thermal cycle in FIGS. 1-4. A low grade thermal energy source that exists independent of the hybrid thermal cycle in FIGS. 1-4 is generally one which does not involve the first, second or third working fluids. In such an embodiment, a sixth working fluid $F_6$ is used to transfer thermal energy from the low grade thermal energy source 610 to heat exchanger 502. A pump 606 is used to circulate the $F_6$ working fluid to facilitate the transfer of thermal energy. The low grade thermal energy source 610 can be any source that is inherently producing large quantities of low grade heat. An example of such a low grade thermal energy source could be an air conditioning system associated with a commercial building. It is well known that such air conditioning systems produce large quantities of low grade thermal energy as a result of the air conditioning process. This low grade thermal energy associated with an air conditioning system can be used in the embodiment of the invention shown in FIG. 6D. Still, the invention is not limited in this regard and any other thermal energy source can be used for this purpose provided that it produces large quantities of thermal energy as described herein.

Figure 6D:
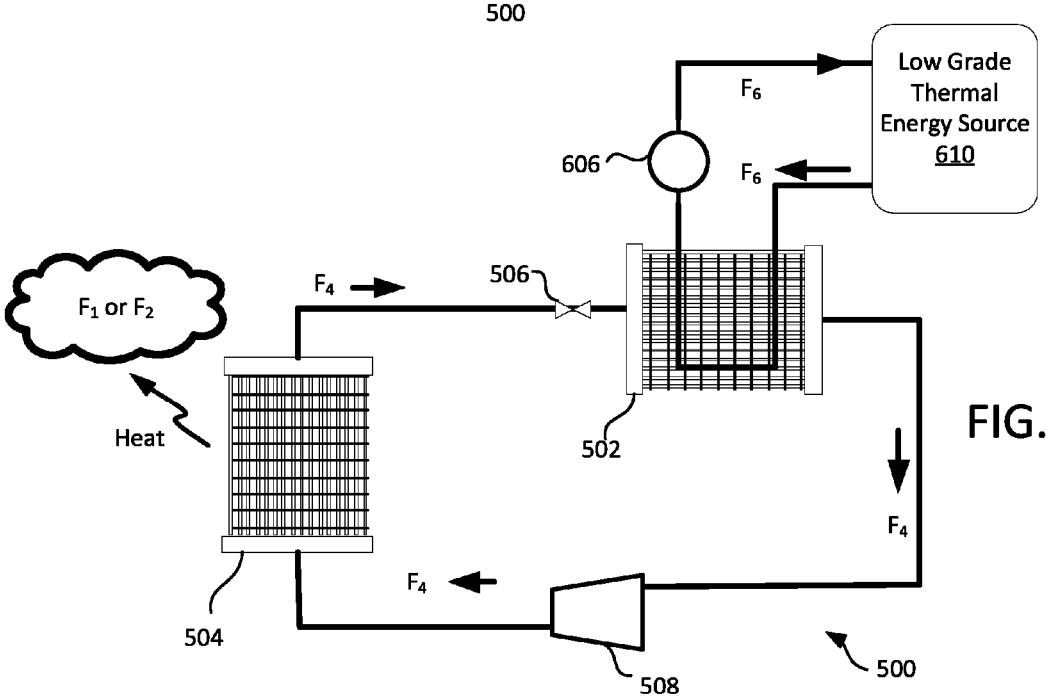
Figure 6E:
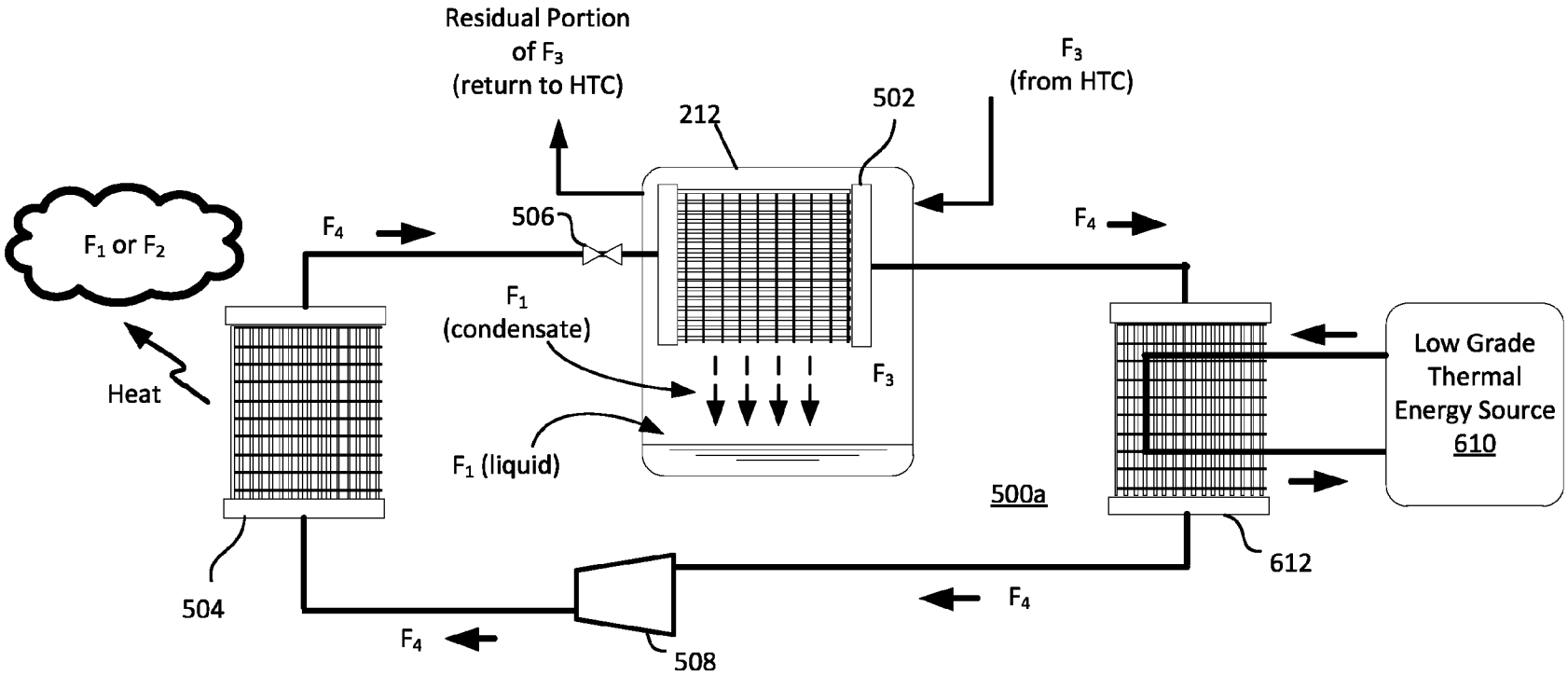

A fifth embodiment shown in FIG. 6E is similar in some respects to the embodiment shown in FIG. 6A insofar as the heat exchanger 502 can be disposed completely or partially within the condenser 212. In such an embodiment, $F_6$ working fluid absorbs heat from the $F_3$ working fluid contained within the condenser 212. More particularly, the $F_3$ working fluid flows around the exterior of the heat exchanger 502 and/or between the flow channels (not shown) of the heat exchanger, which contain cooled $F_4$ working fluid. The heat exchanger 502 facilitates thermal energy absorption by the cooled $F_4$ working fluid. This process cools the $F_3$ working fluid in the condenser, thereby aiding in the production of a condensate comprised of the $F_1$ working fluid. Thereafter the $F_1$ working fluid (condensate) can be re-used in the hybrid thermal cycle as previously described.

The embodiment shown in FIG. 6E is also similar to the embodiment shown in FIG. 6D insofar as it uses an independent low grade thermal energy source 610. However, the independent refrigeration loop 500*a* is modified somewhat insofar as it includes a heat exchanger 612. The $F_4$ working fluid is also circulated to heat exchanger 612 where it can absorb additional thermal energy provided by the independent thermal source 610. The flow path of the $F_4$ working fluid can be arranged as shown so that the $F_4$ working fluid flows from the expander 506, to the heat exchanger 502, and then to the heat exchanger 612. However, the invention is not limited in this regard and in some embodiments it can be advantageous to reverse the order of the heat exchangers 212, 612. In such embodiments (not shown), the $F_4$ working fluid can flow first to the heat exchanger 612 and then to the heat exchanger 212. Those skilled in the art will appreciate that the embodiment shown in FIG. 6E, extracts thermal energy from two different sources. These sources include the $F_3$ working fluid (which is an integral part of the hybrid thermal cycle in system 200) and the thermal energy source 610 (which is independent of the hybrid thermal cycle in system 200.

Figure 7A:
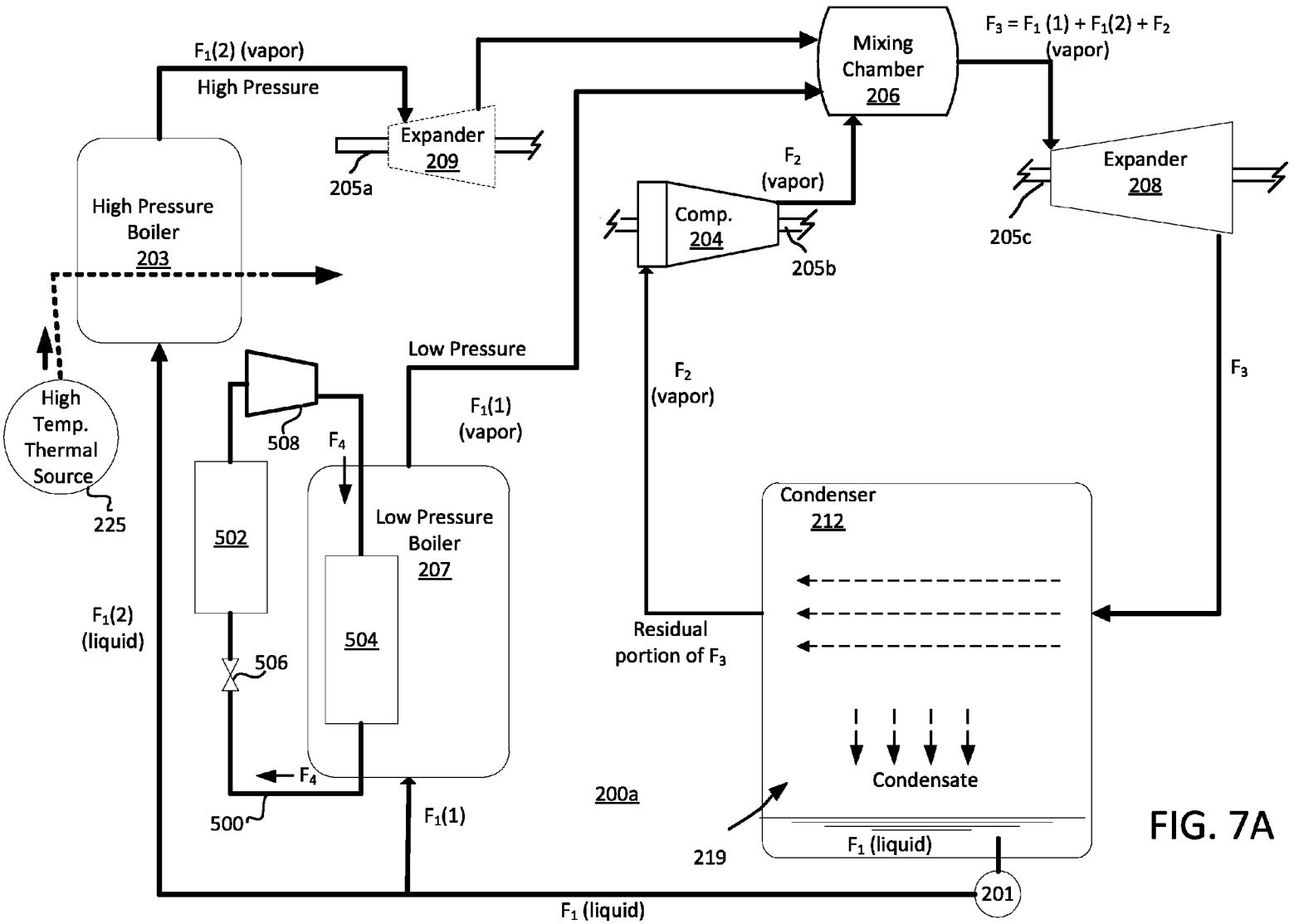
FIGS. 7A-7C are several exemplary embodiments which show how the cooling loop in FIG. 5 can be used in the system of FIG. 2 for providing thermal energy to a working fluid.
Figure 7B:
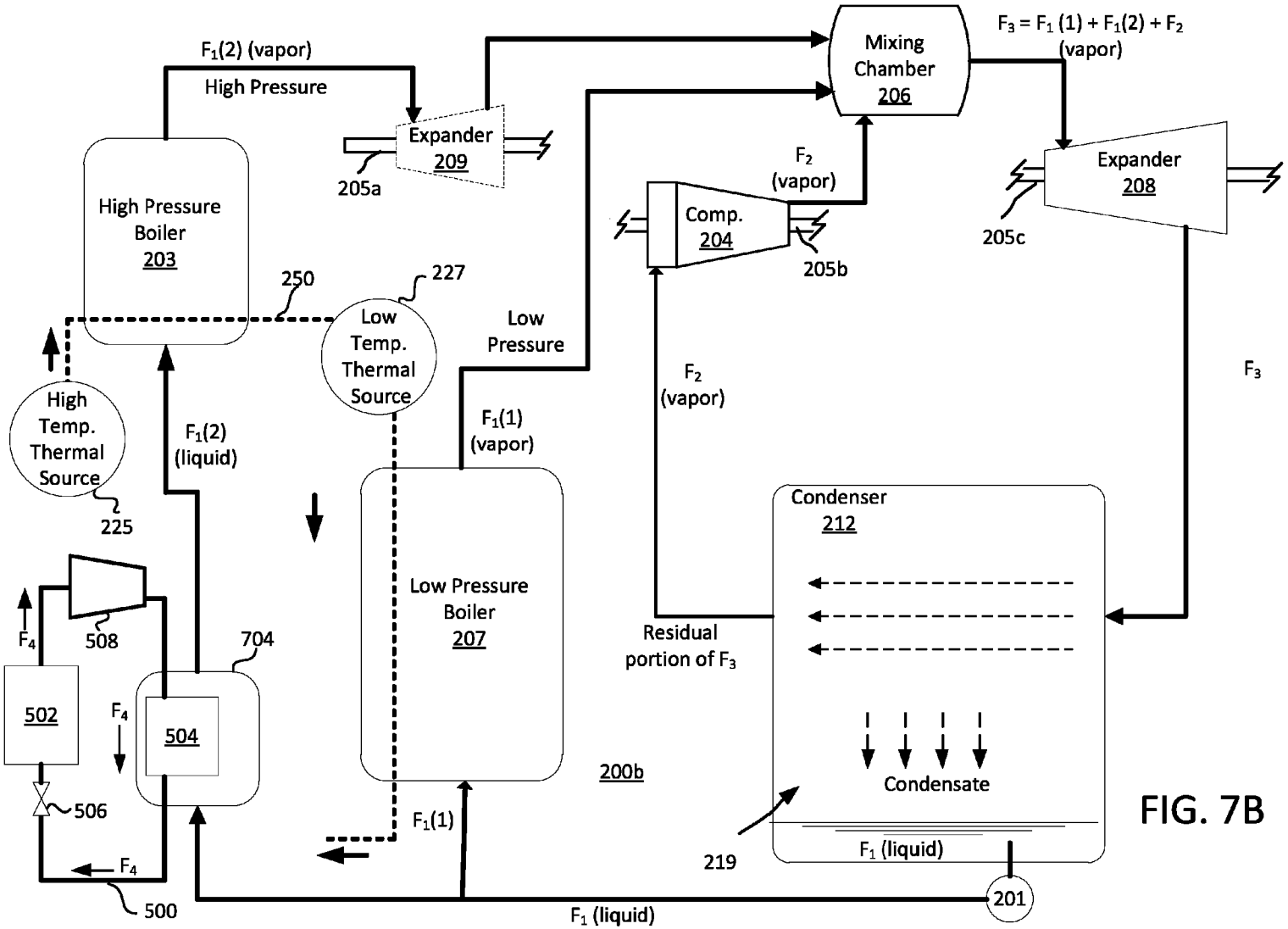
Figure 7C:
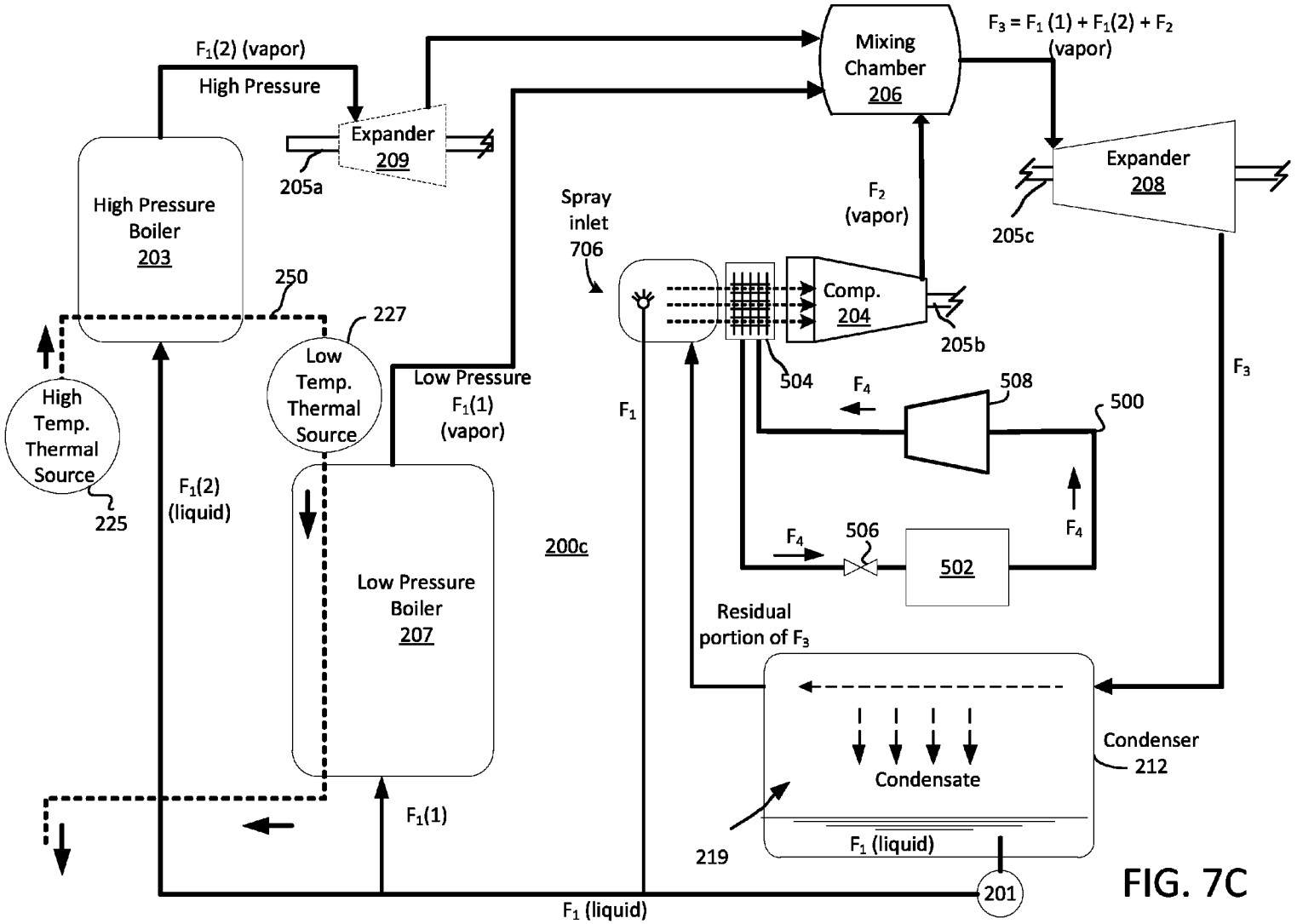

In the embodiments shown in FIG. 6A-6E, various arrangements are shown by which the $F_4$ working fluid can acquire thermal energy from adjacent thermal energy sources. Once such thermal energy has been acquired by the $F_4$ working fluid, it is advantageously transferred to $F_1$ or $F_2$ working fluid as shown in FIG. 5. Referring now to FIG. 7A-7C, several specific examples are provided which explain how such thermal energy can be transferred to the $F_1$ or $F_2$ working fluid. The invention is not intended to be limited to these examples. All that is necessary for purposes of the invention is for thermal energy to be communicated to $F_1$ or $F_2$ by the independent refrigeration loop 500 or 500*a*. Also, it may be noted that the examples in FIGS. 7A-7C are shown as including independent refrigeration loop 500. In each example, it should be understood that as an alternative, independent refrigeration loop 500*a* could be used instead, without limitation.

Referring now to FIG. 7A, the independent refrigeration loop 500 can function in a hybrid thermal system 200*a* to provide low grade thermal energy to the low pressure boiler 207. In such an embodiment, the independent refrigeration loop 500 functions as the low temperature thermal source 227 and low grade thermal energy is provided to the $F_1(1)$ working fluid. Alternatively, as shown in FIG. 7B, independent refrigeration loop 500 can be used in hybrid thermal system 200*b* to pre-heat $F_1(2)$ working fluid in a pre-heater 704, prior to the working fluid being communicated to the high pressure boiler 203. As previously noted, the low pressure boiler 207 is optional in certain embodiments of the invention. It may be noted that FIG. 7B is an example of such an embodiment where a low pressure boiler 207 could be omitted.

In a further alternative embodiment shown in FIG. 7C, the independent refrigeration loop 500 is used to communicate thermal energy to the $F_2$ working fluid. More particularly, the thermal energy acquired by the $F_4$ working fluid can be used in hybrid thermal system 200*c* to communicate available thermal energy to the $F_2$ working fluid. In such embodiments, the residual portion of $F_3$ from the condenser 212 can be circulated in or through heat exchanger 504 as shown. In some implementations of the system, it can be desirable to add a spray of $F_1$ working fluid to the residual portion of $F_3$. The spray of $F_1$ working fluid can be created at a spray inlet 706. In such embodiments, the thermal energy supplied by heat exchanger 504 can be used to help vaporize the liquid spray of $F_1$ before or during the compression process associated with compressor 204. Notably, if a spray of $F_1$ working fluid is added to the residual portion of $F_3$ as described herein, then the mixture of these two working fluids is, by definition, the $F_2$ working fluid. It should be noted that FIG. 7C is another example of an embodiment where a low pressure boiler 207 could be omitted.

The various cycles described herein are an improvement over other cycles because they posses the inherent capacity to use larger quantities of the available source energy (i.e., heat energy) effectively over a broad range of temperatures. There is no compromise to the integrity of basic thermodynamic principles or processes in the overall cycle configuration. In fact, each of the separate process steps described in the cycle herein represents a well understood thermodynamic process. The dynamics of each cycle portion can be traced to similar processes occurring independently in conventional systems. Still, this invention goes beyond such conventional methods and systems because they do not combine process steps in the manner described herein, and therefore do not achieve the same results.

Computer models have been developed to evaluate the details of each of the cycle processes, the relationships across the individual cycle boundaries, and the hardware that supports each specific process. These models facilitate evaluation of the cycle as a whole. The cycle advantageously involves improving thermal to power conversion efficiencies at lower source energy temperatures. This approach is afforded by having the capability to use a larger quantity of the source energy over a given temperature range and in addition is capable of re-using a portion of normally rejected thermal energy by means of re-circulation. Accordingly, the computer models involve an evaluation process that incorporates iterative calculations within the performance simulations to account for the recycled energy. Such modeling and simulation has validated this unique method of using latent heat energy through appropriate placement of vapor state transitions. The resulting method and apparatus is capable of converting a greater portion of available thermal source energy to work than is currently understood to be possible using conventional means known today.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

I claim:

1. A system for producing work from heat in a continuous cycle, comprising:

a low pressure boiler which heats a first flow of a first working fluid having a first chemical composition using a low temperature thermal source to form a first flow of first working fluid vapor;

a high pressure boiler which heats a second flow of said first working fluid using a high temperature thermal source having a temperature higher than said low temperature thermal source, to produce a second flow of first working fluid vapor at a pressure higher than said low pressure boiler;

a compressor which compresses a second working fluid in vaporous form, the second working fluid having a second chemical composition different from the first chemical composition;

a mixing chamber which receives said first flow of first working fluid vapor from the low pressure boiler, the second flow of first working fluid vapor from the high pressure boiler, and the second working fluid from the compressor, said mixer facilitating the formation of a third working fluid by mixing said first flow of first working fluid vapor, said second flow of first working fluid vapor, and said second working fluid in compressed form as received from the compressor, and which facilitates a transfer of thermal energy directly between said second working fluid, said first flow of first working fluid vapor, and said second flow of first working fluid vapor, exclusive of any intervening structure;

an expander which receives the third working fluid from the mixing chamber and expands said third working fluid after or during said transfer of thermal energy;

a condenser which receives the third working fluid that is exhausted from the expander, the condenser arranged to cool said third working fluid to extract said first working fluid, in the form of a condensate, and a residual portion of said third working fluid from which said condensate has been extracted, said second working fluid comprised of said residual portion;

a heat exchanger disposed within a portion of the condenser, the heat exchanger having a low pressure expansion zone defined therein which is arranged to receive at its input port the residual portion of the third working fluid after the condensate has been extracted therefrom, and having an output port coupled to the input of the compressor which communicates the residual portion to the compressor;

an expansion valve which facilitates a flow of the residual portion from an internal chamber of the condenser to the low pressure expansion zone;

wherein the residual portion remains exclusively in a vaporous state while passing through the expander, the condenser, and the low pressure expansion zone, and functions as a refrigerant for purposes of effecting cooling of the third working fluid; and a refrigeration loop containing a fourth working fluid which extracts available thermal energy from an available thermal energy source, and moves said available thermal energy to at least one of the first working fluid and the second working fluid.

2. The system according to claim 1, wherein said available thermal energy source is a system which produces low grade thermal energy exclusive of said first, second or third working fluids.

3. The system according to claim 1, wherein said low pressure boiler uses said fourth working fluid to heat said first flow of said first working fluid in said low pressure boiler.

4. The system according to claim 1, further comprising a pump which recirculates said first working fluid recovered as condensate in said condenser to said high pressure boiler and said low pressure boiler.

* * * * *